US008544366B2

(12) United States Patent
Leyva et al.

(10) Patent No.: US 8,544,366 B2
(45) Date of Patent: Oct. 1, 2013

(54) SPARK PLUG REMOVAL TOOL APPARATUS

(75) Inventors: Hugo Oswaldo Castan Leyva, Wheatridge, CO (US); Daniel J. Cisneros, Lakewood, CO (US)

(73) Assignee: Daniel J. Cisneros, Lakewood, CO (US)

( * ) Notice: Subject to any disclaimer, the term of this patent is extended or adjusted under 35 U.S.C. 154(b) by 254 days.

(21) Appl. No.: 13/219,704

(22) Filed: Aug. 28, 2011

(65) Prior Publication Data

US 2013/0047792 A1 Feb. 28, 2013

(51) Int. Cl.
*B25B 13/06* (2006.01)

(52) U.S. Cl.
USPC ..... 81/124.4

(58) Field of Classification Search
USPC ..... 81/121.1, 124.4, 124.5; 29/282, 29/283; 279/42, 52, 53
See application file for complete search history.

(56) References Cited

U.S. PATENT DOCUMENTS

| | | | | |
|---|---|---|---|---|
| 4,325,665 | A | 4/1982 | Jukes | |
| 4,730,968 | A | 3/1988 | Diperstein et al. | |
| 5,411,357 | A | 5/1995 | Viscio et al. | |
| 6,439,817 | B1 | 8/2002 | Reed | |
| 6,668,784 | B1 | 12/2003 | Sellers et al. | |
| 7,249,540 | B1 * | 7/2007 | Hacker et al. | 81/124.5 |

* cited by examiner

*Primary Examiner* — David B Thomas
(74) *Attorney, Agent, or Firm* — Roger A. Jackson

(57) ABSTRACT

A spark plug removal tool apparatus and method for a spark plug having components of an extended smooth spark arc producing terminal portion, an adjacent helical threaded portion, an adjacent hex drive, an adjacent insulator portion, and a terminal electrical interface extension. The tool apparatus includes a non rotating collet extension having a plurality of fingers to removably engage the electrical interface and an inner surrounding sidewall that threadably engages the collet, also an outer surrounding sidewall rotatably engaged to the inner surrounding sidewall not having one-way axial movement as between the inner and outer surrounding sidewalls, wherein the collet, inner, and outer surrounding sidewalls are all co-axial. Operationally, when the tool starts to unscrew the spark plug from an engine head, an axial non-rotating force is applied to the electrical interface extension that helps prevent separating damage between the spark plug components.

6 Claims, 14 Drawing Sheets

SPARK PLUG REMOVAL TOOL APPARATUS

TECHNICAL FIELD

The present invention relates generally to a spark plug removal tool apparatus. More specifically, the present invention relates to a multiple threaded tool insert with a series of co-axial elements for the removal of a carbon coated extended arc producing tip spark plug that tends to be adhered or welded to the engine head, wherein prior art tools tend to fracture and cause separating damage as between the extended arc producing tip and the remaining spark plug components, resulting in the broken extended arc producing tip remaining in the engine head requiring extensive rework in drilling out the broken extended arc producing tip and re-threading the engine head for a new spark plug, or having to remove the engine head from the engine to gain access to the broken extended arc producing tip.

BACKGROUND OF INVENTION

Materials typically exhibit a variety of different failure mechanisms, depending upon the type of material, how it is manufactured, and the stresses present upon the material for its intended use. There are rigid and brittle materials going all the way toward gummy and soft materials, especially related to metals, like cast iron would be rigid and brittle and aluminum would be soft and gummy, with a typical carbon steel being somewhere between these two extremes being softer and more pliable than cast iron, however, having more rigidity and strength than aluminum. This is why carbon steel is a popular all around material to use as it has the flexibility for many different applications, especially for example where you would have heavy bearing and shear loads upon the material, as in the case of a thread. Wherein on a thread you would have a high bearing load from the metal to metal face contact of the thread flank faces pressing as against one another with a high force coupled with a high shear stress component occurring between the mating threads that is parallel to the radial axis of the threads or more commonly known at the thread "pitch line" which is the theoretical axis at somewhat of a mid-point as between the mated threads running parallel to the thread radial axis.

Thus an ideal material for threads is first a hard faced material that would do well under the high bearing load, such as to resist inter-granular adhesion as between the thread flanks, which can make threaded parts virtually impossible to disassemble. Further, another aspect of the ideal thread material would be to have good shear resistance which would means in the thread case for the material to be somewhat soft and flexible to "give" when under thread load so that a thread has a gradual "tightening" feel as the shear deflection gradually increases. This would be as opposed to a very rigid material that would deflect little from shear stress and then suddenly fail in a shear fracture, meaning that as an individual would tighten the thread is would suddenly "strip" and be ruined without much warning when tightening the thread, which would be undesirable. However, on the other hand if the material were too soft and gummy, the thread in shear would fail also without warning, wherein the individual would be tightening the thread and without much rotational resistance, the thread would "strip" easily.

Typically, the thread shear stress and thread flank bearing load are controlled by the rotational torque applied to the thread, however, in the real world this is highly inaccurate for one predominating reason being that controlling of the torque assumes a constant coefficient of friction as between the thread flanks as they are sliding as against one another, wherein this assumption of the friction factor is often highly inaccurate and can change dramatically depending upon the bearing load, surface finish of the thread flanks, and cleanliness/lubrication of the thread flank surfaces. The torque control problems also apply to the individual who tightens the threads by "feel" which is the same as torque control and thus has all of the same aforementioned problems. Ideally the way to properly tighten a thread as in critical applications such as a pressure vessel flange, is to hydraulically pre-stretch the threaded stud to the proper preload in tensile stress and ten to hand snug the threaded nut upon the stud, then relieving the hydraulic "preload stretch" wherein the stud will pull the threaded nut into axial tightness, this method completely eliminates the variability of the previously mentioned problem of thread flank to flank friction as it is not relied upon at all.

Unfortunately, the hydraulic method is not possible without a lot of free volumetric space around the assembled thread, plus it is quite costly and really only justified for safety critical thread retaining applications, such as a pressure vessel, wherein failure of the thread unexpectedly would result in a high degree of danger. As ideally the thread should see its maximum stress during assembly and a lower stress during use, thus this would eliminate an unexpected failure of the thread in later use, i.e. if it does not strip during assembly it never will after that.

However, in the real world the best material are not always used for economic reasons (too soft or too hard), high inaccuracies exist due to the torque issue previously discussed resulting in overloaded threads further resulting in deformed, damaged, or striped threads being an all too common occurrence. The well recognized problem is in the difficulty in repairing the threads, as the threads may be just a portion of a much larger machine, making it difficult to remove and isolate the failed threaded area for repair, plus there is always the consideration of what the failed thread mates with, as the thread repair usually requires restoration back to its original size before it failed. This restoration requires the adding of material by welding, inset, or otherwise, which can be difficult given that the failed thread may not be easy to isolate for the adding of material.

Further, due to carbon buildup within the combustion chamber from the by-products of fuel combustion in conjunction with the high pressures and temperatures present in the combustion chamber causes carbon deposits both in the thread area and the extended arc producing tip that protrudes into the combustion chamber through the engine head. Over time these carbon deposits essentially "weld" the spark plug to the engine head especially in the thread and/or extended arc producing tip areas, and when it comes time to remove and replace the spark plug and rotational torque is applied to the spark plug to unscrew it, the spark plug essentially yields (breaks) somewhere between the thread/extended arc producing tip that is welded to the engine head and the wrench hex attachment, causing substantial repair time and cost. Thus the repair typically results in the engine head requiring extensive rework in drilling out the broken extended arc producing tip/threads and re-threading the engine head for a new spark plug, plus the difficult job of cleaning out the combustion chamber of debris, or having to remove the engine head from the engine to gain access to the broken extended arc producing tip. This repair or portions of it recognized in the prior art with the following examples given.

Starting with U.S. Pat. No. 6,439,817 to Reed disclosed is an insert retention mechanism. The insert in Reed is a substantially cylindrical construct having an exterior thread which meshes with the newly threaded bore of the casting and an interior bore having threads complementary to the dimensions of the preexisting fastener previously residing within the old bore. In this way, in Reed the same sized fastener or spark plug that was installed originally within the metal casting can be used after the repair. Besides fasteners and spark plugs, the insert in Reed also finds utility, inter alia, for repairing hydraulic fitting threads, pipe threads and as a blind hole insert. Moreover, in Reed the instant invention addresses and resolves any problems associated with an attempt to subsequently remove the fastener or spark plug after the repair. In some situations, typically harsh operating environments involving corrosion or galvanic attraction between the various components of a system, the mating area between the threads of the fastener or spark plug can become seized to the insert. When this occurs, an attempt to remove the fastener or spark plug can sometimes cause rotation of the insert in conjunction with the fastener or spark plug, thwarting removal of the fastener or the spark plug alone.

Thus, the solution in Reed preferably includes the utilization of both specially formed threads and a shoulder on the insert which is adapted to provide a cylindrical bore strategically located to vertically align with the meshing exterior threads of the insert and the threads formed in the bore of the material being worked on. A top surface of the insert's shoulder in Reed includes a cylindrical bore. After the insert has been placed within the material to be repaired in Reed, a hole may be drilled extending the cylindrical bore into the juncture of the exterior threads of the insert and the threads of the bore in the material. Finally, in Reed, a cylindrical pin is driven into the cylindrical bore through the shoulder and into the drilled area of the exterior threads of the insert and the threads of the bore of the material so that the insert will no longer readily move with respect to the material because the flight of the threads of the insert on an exterior surface thereof will be opposed by the placement of the cylindrical pin and its retention by the threads of the bore of the material. Where the insert in Reed already includes a vertical channel defining a thread gap aligned with the cylindrical bore of the insert's shoulder, the drilling step is not mandatory. In this case, for Reed driving the cylindrical pin will actually improve insert retention because the threads in the bore contacted by the pin distort and therefore enhance retention of the insert in the bore, see Column 2, lines 26-67, and Column 3, lines 1-5. Note that in Reed, the pin driving into the threads is common in this art area to retain the threaded insert into the larger rethreaded base material, however, it is not optimum at all as the pin deforming the base material threads causes stress risers due to sharp edges that can lead to base material cracking, thereby causing the thread repair to ultimately cause more damage to the base material.

Continuing in the threaded insert prior art area in looking at U.S. Pat. No. 5,411,357 to Viscio, et al. disclosed is a screw thread locking insert for locking a threaded insert into a prepared hole in a parent material. The device in Viscio et al., includes a locating portion, a locking portion and a gripping portion which is removed upon installation. The locating portion in Viscio et al., comprises a finger which is positioned in a preformed slot in the external threads of the threaded insert. The locking portion in Viscio et al., which extends outwardly from the locating portion, is driven across the corresponding threads of the parent material to shear and distort the threads and lock the insert in place. The gripping portion in Viscio et al., which extends outwardly from the locking portion is used by the installer to position the device during installation and is then broken off. Note also that as in Reed, Viscio et al., has the same undesirable issue relating to the drive pin being driven into the base material threads.

Further in the threaded insert prior art, in looking at U.S. Pat. No. 4,325,665 to Jukes disclosed a self-locking insert having a generally tubular shape with substantial portions of the exterior and the interior being threaded. The interior in Jukes includes a portion which does not have complete threads. Positioned within the exterior thread in Jukes outwardly from the incomplete threads of the interior are one or more locking plugs. When installing the insert in Jukes, a threaded insert driver is threaded into the interior of the insert until it engages the incompletely threaded portion of the interior. The insert in Jukes is then threaded into a tapped hole in a base material until a flanged or outwardly flared head on the exterior of the insert engages the base material. The insert driver in Jukes is then forcibly rotated further to complete the threads in the interior of the insert which creates a force outward against the walls of the insert. This force in Jukes urges the locking plugs outward more easily than the portion of the insert surrounding the plugs so that the plugs engage the walls of the tapped hole and securely lock the insert in place. Preferably in Jukes, the apertures in which the plugs are positioned, extend at an angle with respect to a radial line of the insert, when a spherical plug is used, wherein this cams a spherical plug to engage more tightly into the walls of the tapped hole, when torque is applied to attempt to remove the insert, see Column 2, lines 23-48. Thus in Jukes, with the outwardly biased thread plugs an attempt is made to minimize the negative stress riser effect from the previously discussed pins to accomplish the same function of preventing reverse rotation of the threaded insert.

Continuing in the prior art, also in looking at U.S. Pat. No. 6,668,784 to Sellers, et al. disclosed a thread insert and method to replace the damaged threads and tapered seat in a spark plug bore of an internal combustion engine that allows for the continued use of the original factory specified spark plugs where the original threads in the spark plug bore have been damaged by stripping or cross threading. The thread insert's inner bore in Sellers, et al. is designed to replace the original threads and tapered seat in the cylinder head. The thread insert in Sellers, et al. may be adapted to fit any internal combustion engine using tapered seat spark plugs, and is particularly useful in deep spark plug bores with limited access as found in the aluminum heads of Ford Motor Company modular engines. The insert in Sellers, et al. includes a flange head that determines how far into the head the insert can extend and a recess below the flange to collect any bonding agent that may be squeezed from the threads during installation of the insert. Special tools in Sellers, et al. make the installation of the insert easy and accurate. Note that also Sellers, et al. recognizes the drive pin problems in causing stress risers in the threads in the base material by Sellers, et al. using the bonding agent in the chamber to lock the insert into the base material oversized new threaded hole.

Moving ahead in the prior art for threaded inserts, looking at U.S. Pat. No. 4,730,968 to Diperstein, et al. disclosed a self-tapping, self-aligning thread repair insert. The insert in Diperstein, et al. is an annular sleeve having a threaded interior surface, a partially threaded exterior surface, and an opening in the form of a slot. The exterior surface in Diperstein, et al. has a tapered portion between a straight threaded portion and a straight thread-free portion. The thread-free portion in Diperstein, et al. and the opening are adjacent an end of the sleeve. The thread-free portion surface in Diperstein, et al. is free of threads for a distance of at least 1.5 thread widths from the end of the sleeve, see Column 1, lines 35-45. Diperstein, et al. uses a self tapping threaded insert which can save the use of some additional tooling that most of the other prior art requires, however, the strength of the insert can be compromised due to the self tapping slits, see FIGS. 5 and 6, wherein the thread length is less than the thread diameter, meaning that the threads are weaker than the bolt, further as previously mentioned having to tap new threads for a larger hole in the base material leaves metal chips that come from the cutting of the new larger threads. The problem of these metal chips is that say in an automotive engine cylinder head they would fall into the cylinder and cause gouging of the finely honed cylinder sidewalls that will lead to excessive engine wear and damage, the way out of this would be to remove the head from the engine, being a difficult and time consuming task.

What is needed is a spark plug removal tool apparatus that helps to remove the spark plug from the engine head without destroying the spark plug in the first place to eliminate the need for the expensive and time consuming repair of removing the damaged spark plug from the engine head as previously described.

SUMMARY OF INVENTION

Broadly, the present invention is for a spark plug removal tool apparatus for a spark plug having an extended smooth spark producing terminal portion, an adjacent helical threaded portion, an adjacent hex drive, an adjacent insulator portion, and a terminal electrical interface extension. The spark plug removal tool apparatus includes a collet extension having a longitudinal axis, the collet extension including a removably engaging first end portion having a plurality of cantilevered fingers that flex substantially perpendicular to the longitudinal axis, the fingers have an outer portion that is frustroconical, and at an inner portion that is adapted to removably engage the electrical interface extension, the collet extension also having a threaded mid portion and a second end portion having a first means for imparting a first bidirectional rotational movement about the longitudinal axis. Further included in the spark plug removal tool apparatus is an inner surrounding sidewall having a lengthwise axis, the inner surrounding sidewall having a primary end portion with an inside surface that receives the plurality of cantilevered fingers frustroconical outer portion, the inner surrounding sidewall also having an intermediate portion with a threaded inner surface that threadably engages the threaded mid portion. The inner surrounding sidewall also including an intermediate portion outer surface, wherein the longitudinal axis and the lengthwise axis are co-axial, the inner surrounding sidewall also having a secondary end portion with an annular shoulder forming a flange that is positioned about the lengthwise axis.

The spark plug removal tool apparatus further includes an outer surrounding sidewall having a long axis, the outer surrounding sidewall including a base end portion with an inner hex structure that is adapted to receive the hex drive and axially rest upon the helical threaded portion adjacent to the hex drive. The outer surrounding sidewall also including a center portion whose inner surface forms a slip fit clearance with an intermediate portion outer surface, the outer surrounding sidewall further including a drive end portion that includes a stepped shoulder that is peripheral about the long axis, the stepped shoulder rotationally engages the annular shoulder flange such that the lengthwise axis and long axis are co-axial and the outer surrounding sidewall and the inner surrounding sidewall rotate relative to one another about said lengthwise and long axes. Wherein the inner surrounding sidewall is fixed axially in relation to the outer surrounding sidewall for movement toward the base, with the movement being parallel to the lengthwise axis and long axes, the drive end portion also including a second means for imparting a second rotational movement about the long axis. Wherein operationally when the second rotational movement is applied to the second means the second rotational movement is transferred to the adjacent hex drive that starts to unscrew the spark plug from an engine head, wherein the helical threaded portion exerts an axial force against the base away from the engine head, wherein the axial force translates to the inner surrounding sidewall via the stepped shoulder and the flange to the collet extension via the threaded inner surface and threaded mid portion to the cantilevered fingers that engage the electrical interface extension. This resulting in the axial force acting upon the electrical interface extension in lockstep with the axial force present at the helical threaded portion, wherein there is no rotational engagement as between the electrical interface extension and the helical threaded portion to help prevent separating damage between all of a portion of the spark plug components of the extended smooth spark producing terminal portion, the adjacent helical threaded portion, the adjacent hex drive, the adjacent insulator portion, and the terminal electrical interface extension.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
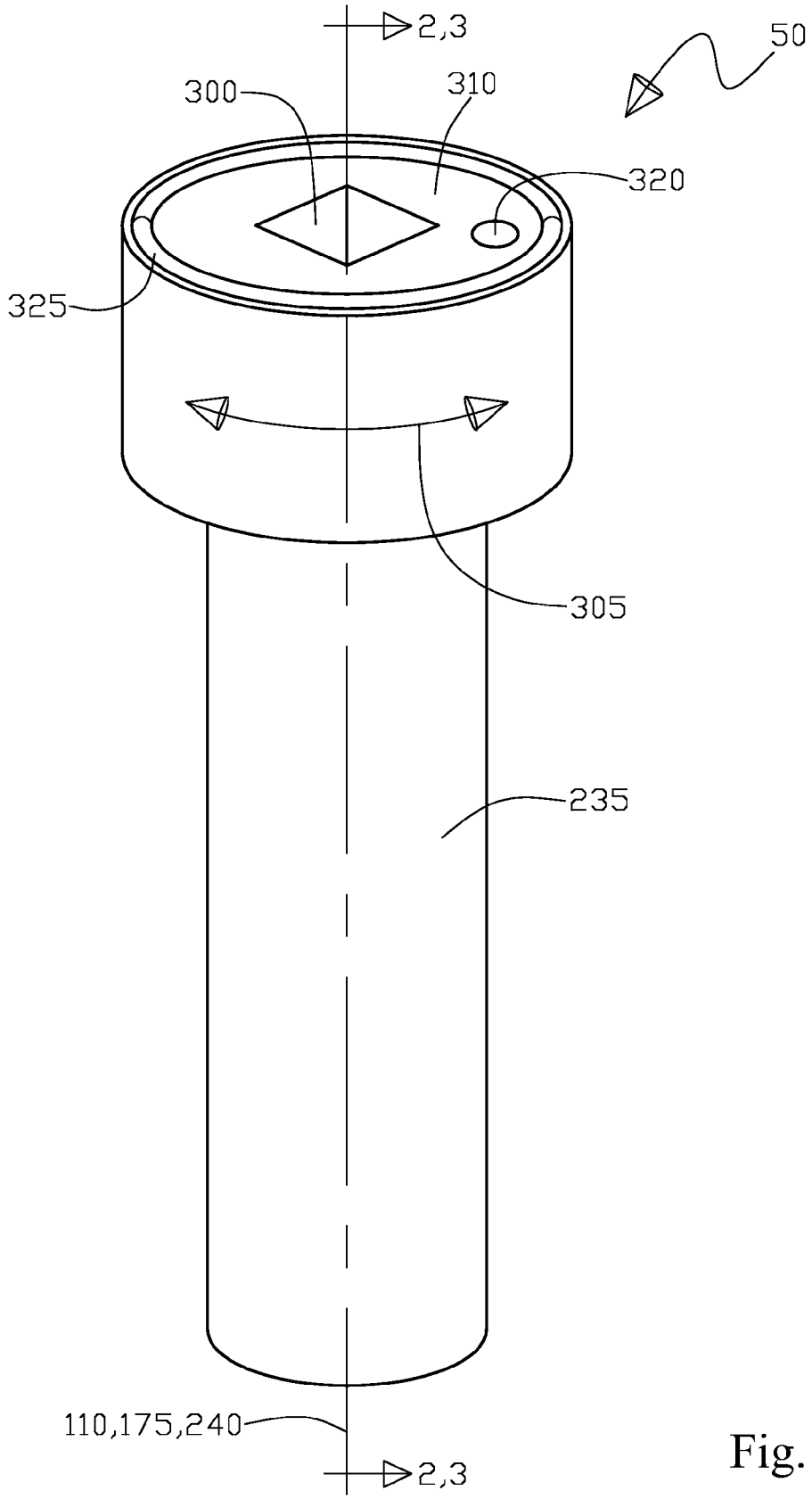
FIG. 1 shows an assembled exterior perspective view of the spark plug removal tool apparatus including the sleeve, the sleeve inner surface, the aperture, the affixment, the outer surrounding sidewall, and the second rotational movement.

50 Spark plug removal tool apparatus
55 Ratchet driver
60 Extension of ratchet driver 55
65 Engine head
70 Spark plug having an extended smooth spark producing terminal portion
75 Spark plug 70 components
76 Arc producing component 75 of the spark plug 70
77 Extended smooth spark producing terminal portion component 75 of the spark plug 70
80 Adjacent helical threaded portion component 75 of the spark plug 70
85 Adjacent hex drive component 75 of the spark plug 70
90 Adjacent insulator portion component 75 of the spark plug 70
95 Terminal electrical interface extension component 75 of the spark plug 70
100 Separating damage between the spark plug components 75
101 Unscrew spark plug 70
105 Collet extension
110 Longitudinal axis of the collet extension 105
115 Cantilevered fingers in plurality of the collet extension 105
120 First portion of the collet extension 105 that is removably engaging via the cantilevered fingers 115
125 Flex movement of the cantilevered fingers 115 that is substantially perpendicular to the longitudinal axis 110
130 Driving movement of the fingers 115 toward one another
131 Retracting movement of the fingers 115
132 Disengaged fingers 115 from the terminal electrical interface 95
135 Outer portion of the collet extension 105 first portion 120 fingers 115 that is frustroconical
140 Inner portion of the collet extension 105 first portion 120 fingers 115 that is adapted to removably engage the terminal electrical interface extension 95
145 Threads of the collet extension 105
150 Mid portion of the collet extension 105 that is threaded 145
155 Second end portion of the collet extension 105

160 First means for imparting a first bidirectional rotational movement 165 about the longitudinal axis 110 of the collet extension 105 that is in the second end portion 155 of the collet extension 105

161 First hex head of means 160

165 First bidirectional movement

170 Inner surrounding sidewall

175 Lengthwise axis of the inner surrounding sidewall 170

180 Primary end portion of the inner surrounding sidewall 170

185 Inside surface of the primary end portion 180 that receives the plurality of fingers 115 frustroconical outer portion 135

190 Threaded inner surface of the inner surrounding sidewall 170

195 Intermediate portion of the inner surrounding 170 sidewall having the threaded inner surface 190

200 Intermediate portion outer surface of the inner surrounding sidewall 170

205 Secondary end portion of the inner surrounding sidewall 170

210 Annular shoulder of the secondary end portion 205

215 Flange of the annular shoulder 210

220 Recess of the flange 215

225 Balls

230 Rotational friction reduction between the inner surrounding sidewall 170 and the outer surrounding sidewall 235

235 Outer surrounding sidewall

240 Long axis of the outer surrounding sidewall 235

245 Base end portion of the outer surrounding sidewall 235

250 Inner hex structure of the base end portion 245 that is adapted to receive the hex drive 85

255 Axial rest point of the base end portion 245 upon the helical threaded portion 80

260 Center portion of the outer surrounding sidewall 235

265 Inner surface of the center portion 260

270 Slip fit clearance of the inner surface 265 to the intermediate portion 200

275 Drive end portion of the outer surrounding sidewall 235

280 Stepped shoulder that is peripheral about the long axis 240

285 Rotational engagement between the stepped shoulder 280 and the annular shoulder 210 flange 215

290 Relative rotation between the outer surrounding sidewall 235 and the inner surrounding sidewall 170

295 Fixed axial position as between the inner surrounding sidewall 170 and the outer surrounding sidewall 235 to toward the base 245

300 Second means for imparting a second rotational movement 305 about the long axis 240 in the drive end portion 275

305 Second rotational movement

310 Sleeve in the drive end portion 275 recess 330

315 Inner surface of the sleeve 310

320 Aperture of the sleeve 310

325 Affixment from sleeve 310 to drive end portion 275

330 Receptacle in the drive end portion 275

335 Removable pin

340 Rotational lock between the outer surrounding sidewall 235 and the inner surrounding sidewall 170

345 Axial force from the helical thread portion 80 against the base 245 away from the engine head 65

350 No rotational engagement between the electrical interface extension 95 and the helical thread portion 80

370 Prior art removal tool for spark plug 70

375 Carbon buildup in head 65

500 Placing the base end portion 245 and inner hex structure 250 onto the spark plug 70 hex drive 85

505 Inserting the terminal electrical interface extension 95 into the collet extension 105 fingers 115 inner portion 140

510 Placing the pin 335 therethrough the aperture 320 and into the recess 220 to rotationally lock 340 the outer surrounding sidewall 235 to the inner surrounding sidewall 170

515 Rotating the first hex head 161 to drive 130 the fingers 115 into the primary end portion 180 inside surface 185 for the fingers 115 to engage the terminal electrical interface extension 95 via the first bidirectional movement 165

520 Removing the pin 335 from the recess 220 and the aperture 320

525 Rotating the sleeve 310 to unscrew 101 the spark plug 70 from the head 65

530 Rotating the first hex head 161 to retract 131 the fingers 115 from the primary end portion 180 inside surface 185 for the fingers 115 to disengage 132 from the terminal electrical interface extension 95, thus allowing spark plug 70 removal from the spark plug removal tool apparatus 50 via the first bidirectional movement 165

DETAILED DESCRIPTION

Figure 2:
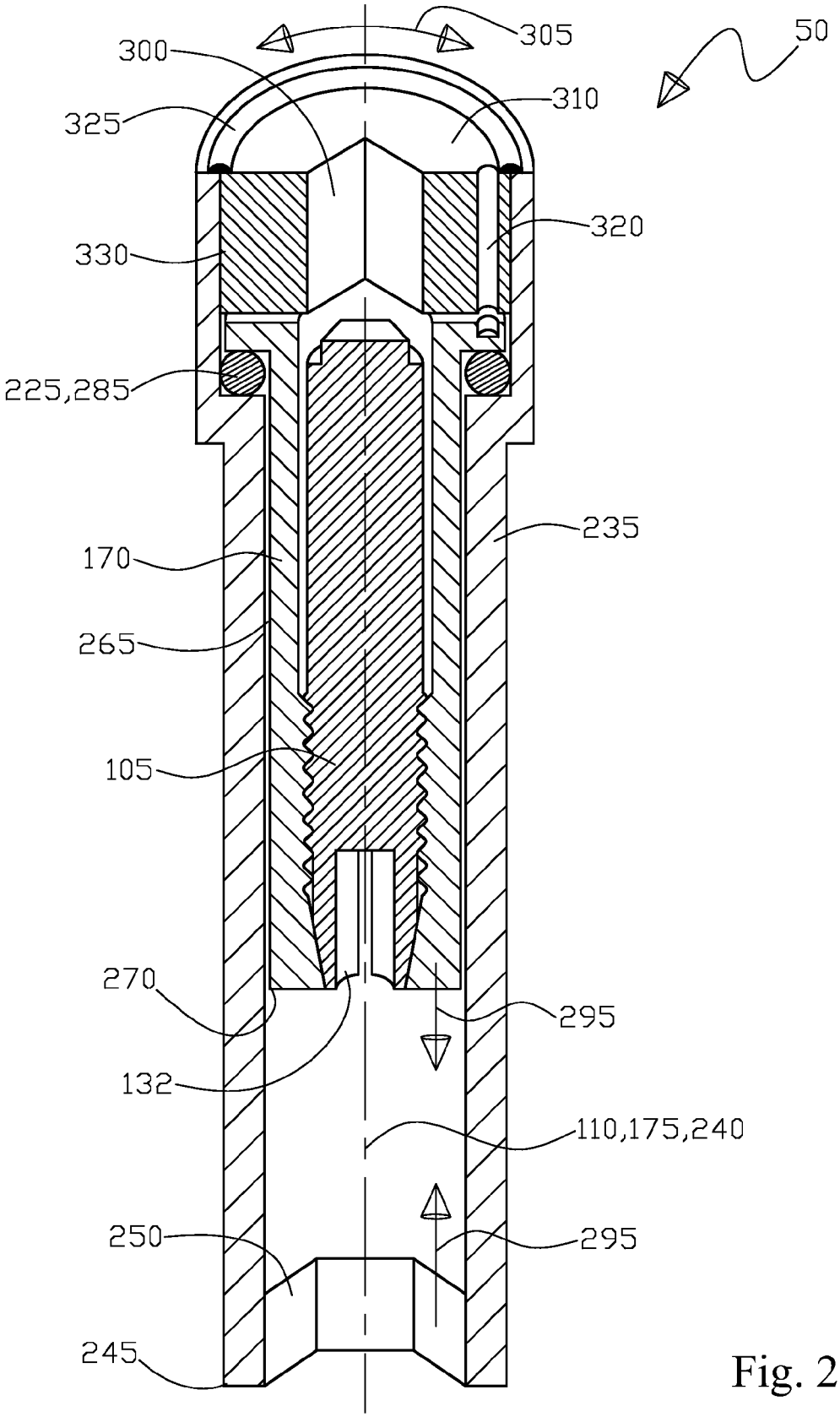
FIG. 2 shows cross section cutaway 2-2 from FIG. 1, showing a semi-perspective view of the spark plug removal tool apparatus internals that include the sleeve, the sleeve inner surface, the aperture, the affixment, the outer surrounding sidewall, the inner hex structure, the base end portion, the second rotational movement, the collet extension, the fingers, the inner surrounding sidewall, the balls between the inner and outer surrounding sidewalls, the co-axial position of the longitudinal, lengthwise, and long axes, and the fixed axial position as between the inner surrounding sidewall and the outer surrounding sidewall base.

With initial reference to FIG. 1 shown is an assembled exterior perspective view of the spark plug removal tool apparatus 50 including the sleeve 310, the sleeve inner surface 315, the aperture 320, the affixment 325, the outer surrounding sidewall 235, and the second rotational movement 305. Next, FIG. 2 shows cross section cutaway 2-2 from FIG. 1, showing a semi-perspective view of the spark plug removal tool apparatus 50 internals that include the sleeve 310, the sleeve inner surface 315, the aperture 320, the affixment 325, the outer surrounding sidewall 235, the inner hex structure 250, the base end portion 245, the second rotational movement 305, the collet extension 105, the fingers 115, the inner surrounding sidewall 170, the balls 225 between the inner 170 and outer 235 surrounding sidewalls, the co-axial position of the longitudinal 110, lengthwise 175, and long 240 axes, and the fixed axial position 295 as between the inner surrounding sidewall 170 and the outer surrounding sidewall 235 base 245.

Figure 3:
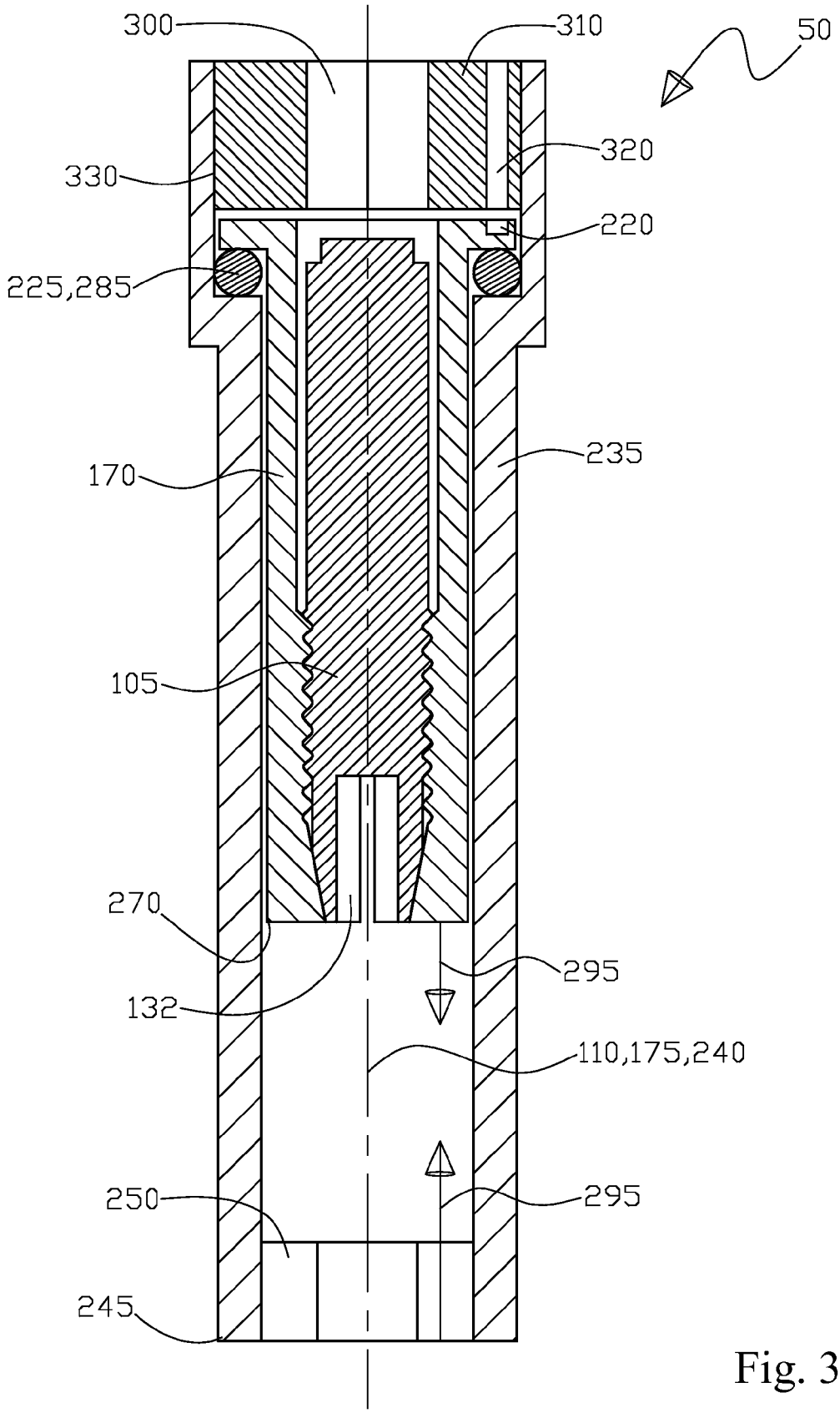
FIG. 3 shows cross section cutaway 3-3 from FIG. 1, showing a cross sectional view of the spark plug removal tool apparatus internals that include the sleeve, the sleeve inner surface, the aperture, the affixment, the outer surrounding sidewall, the inner hex structure, the base end portion, the second rotational movement, the collet extension, the fingers, the inner surrounding sidewall, the balls between the inner and outer surrounding sidewalls, the co-axial position of the longitudinal, lengthwise, and long axes, and the fixed axial position as between the inner surrounding sidewall and the outer surrounding sidewall base.
Figure 4:
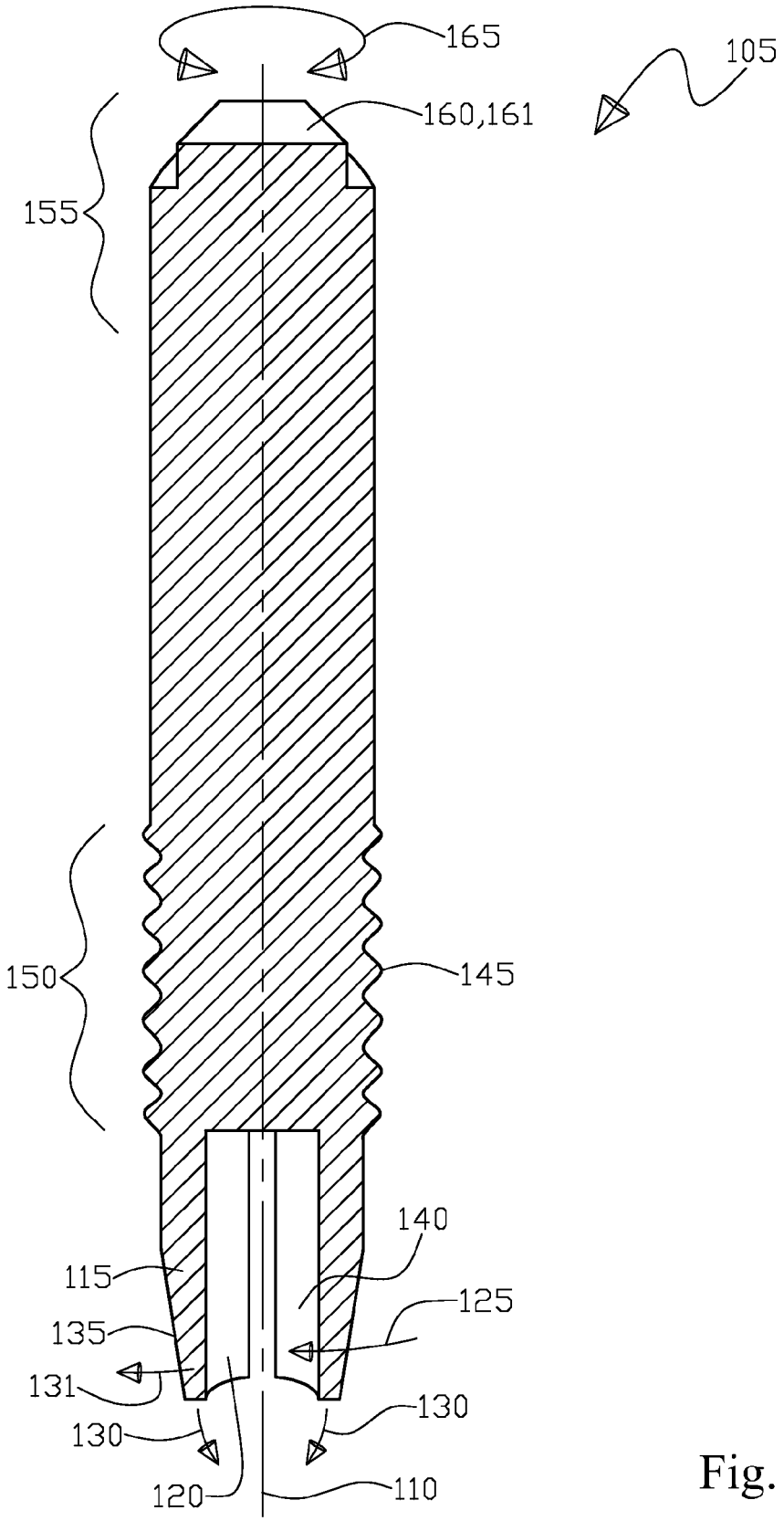
FIG. 4 shows a cross section of the collet extension including the fingers, the frustroconical outer portion, the longitudinal axis, the first portion, the flex movement, the driving movement, the retracting movement, the outer portion, the inner portion, the threads, mid portion, second portion, the first means for imparting the first bidirectional rotational movement, and the first hex head.

Continuing, FIG. 3 shows cross section cutaway 3-3 from FIG. 1, showing a cross sectional view of the spark plug removal tool apparatus 50 internals that include the sleeve 310, the sleeve inner surface 315, the aperture 320, the affixment 325, the outer surrounding sidewall 235, the inner hex structure 250, the base end portion 245, the second rotational movement 305, the collet extension 105, the fingers 115, the inner surrounding sidewall 170, the balls 225 between the inner 170 and outer 235 surrounding sidewalls, the co-axial position of the longitudinal 110, lengthwise 175, and long 240 axes, and the fixed axial position 295 as between the inner surrounding sidewall 170 and the outer surrounding sidewall 235 base 245. Further, FIG. 4 shows a cross section of the collet extension 105 including the fingers 115, the frustroconical outer portion 135, the longitudinal axis 110, the first portion 120, the flex movement 125, the driving movement 130, the retracting movement 131, the outer portion 135, the inner portion 140, the threads 145, mid portion 150, second portion 155, the first means 160 for imparting the first bidirectional rotational movement 165, and the first hex head 161.

Figure 5:
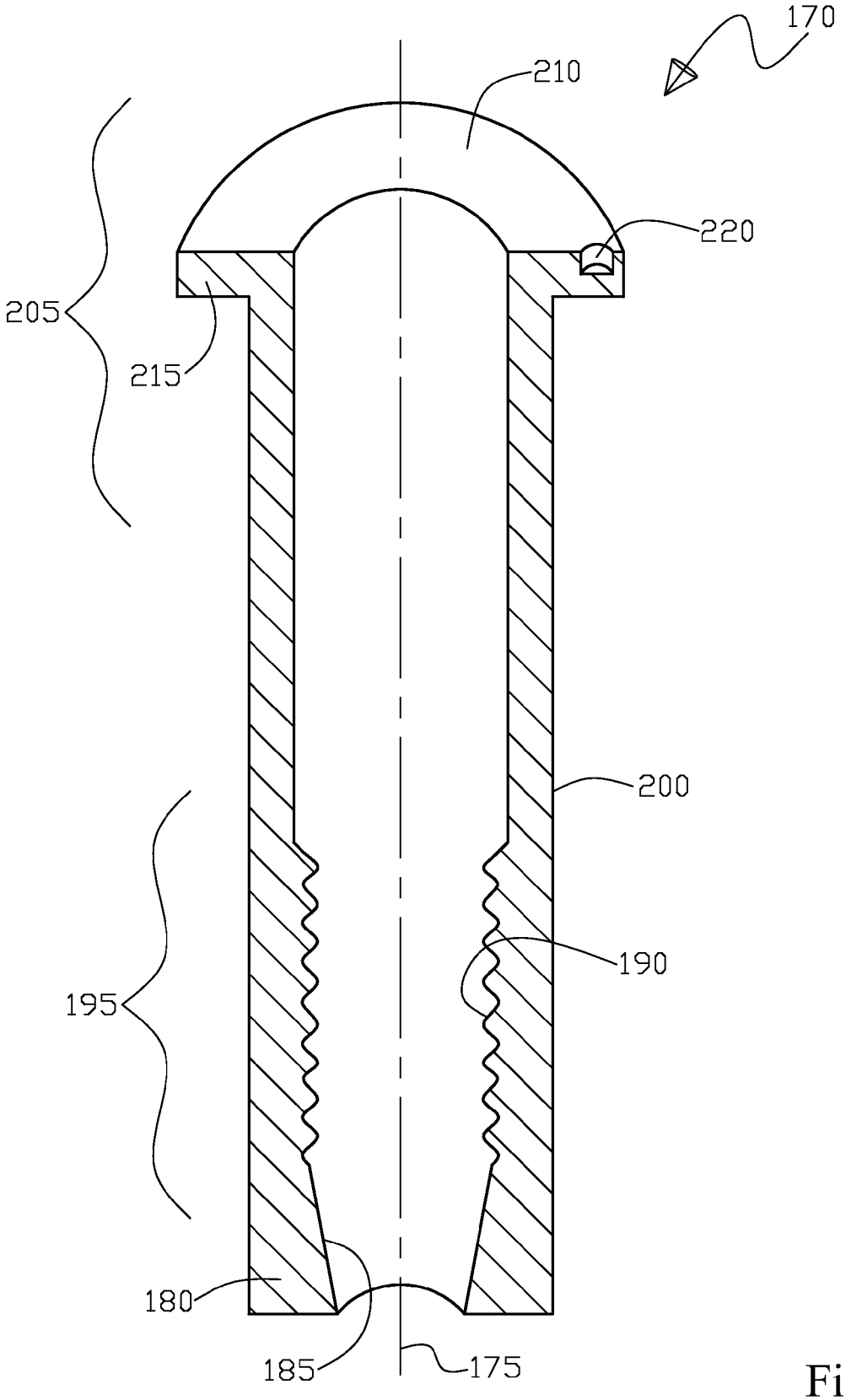
FIG. 5 shows a cross section of the inner surrounding sidewall that includes the lengthwise axis, the primary end portion, the inside surface, the threaded inner surface, the intermediate portion, the intermediate portion outer surface, the secondary end portion, the annular shoulder, the flange, and the recess.
Figure 6:
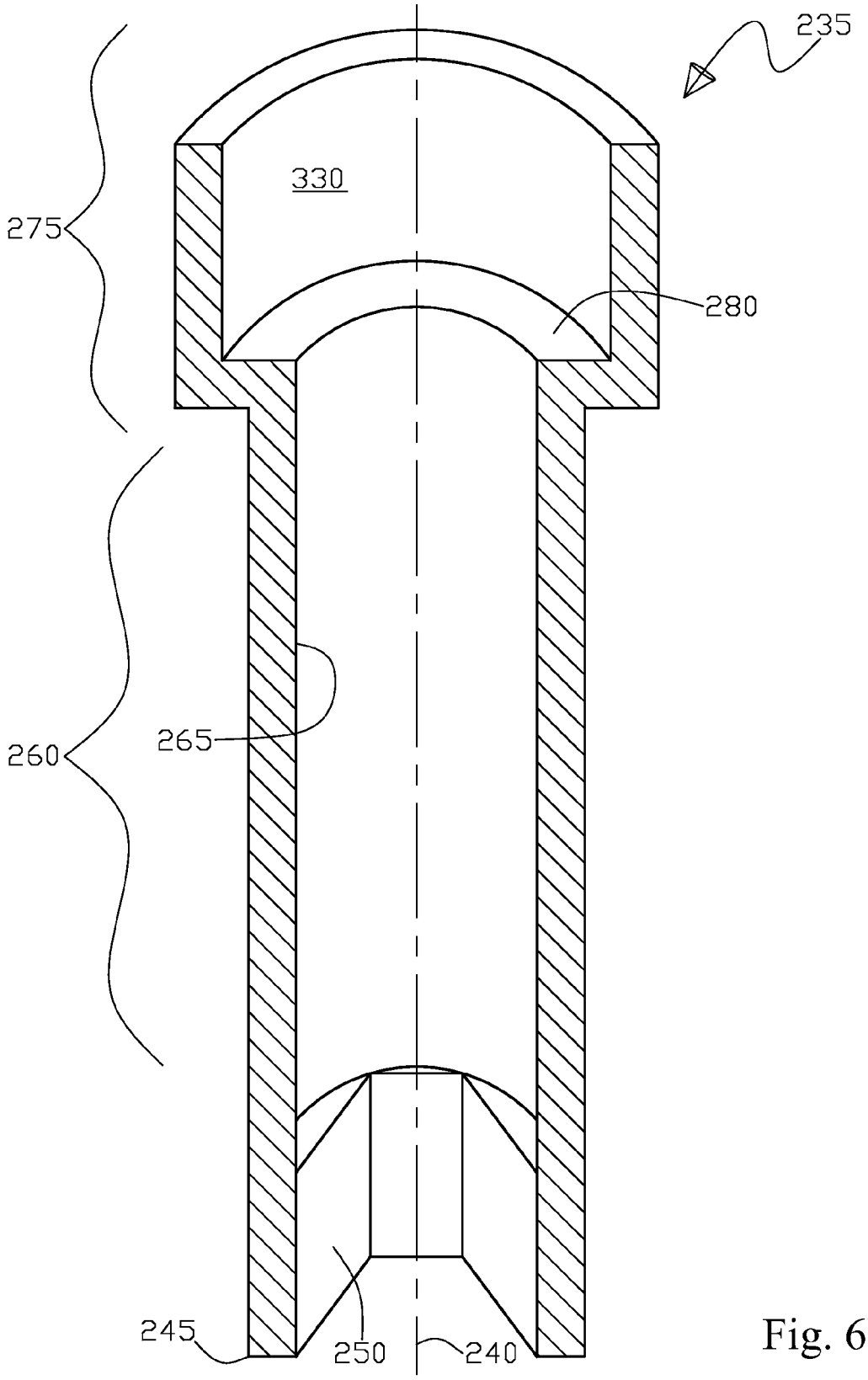
FIG. 6 shows a cross section of the outer surrounding sidewall including the long axis, the base end portion, the inner hex structure, the center portion, the inner surface, the drive end portion, the stepped shoulder, and the receptacle.
Figure 7:
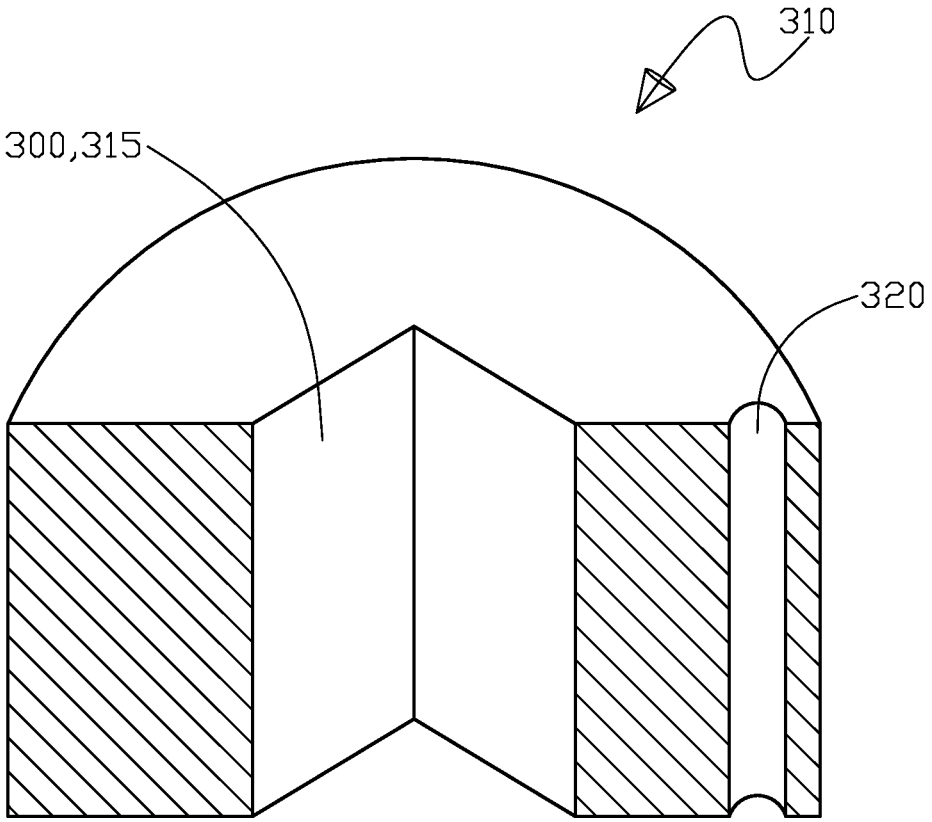
FIG. 7 shows a cross section of the sleeve that includes an inner surface and an aperture.

Next, FIG. 5 shows a cross section of the inner surrounding sidewall 170 that includes the lengthwise axis 175, the primary end portion 180, the inside surface 185, the threaded inner surface 190, the intermediate portion 195, the intermediate portion outer surface 200, the secondary end portion 205, the annular shoulder 210, the flange 215, and the recess 220. Continuing, FIG. 6 shows a cross section of the outer surrounding sidewall 235 including the long axis 240, the base end portion 245, the inner hex structure 250, the center portion 260, the inner surface 265, the drive end portion 275, the stepped shoulder 280, and the receptacle 330. Yet, FIG. 7 shows a cross section of the sleeve 310 that includes the inner surface 315 and an aperture 320.

Figure 8:
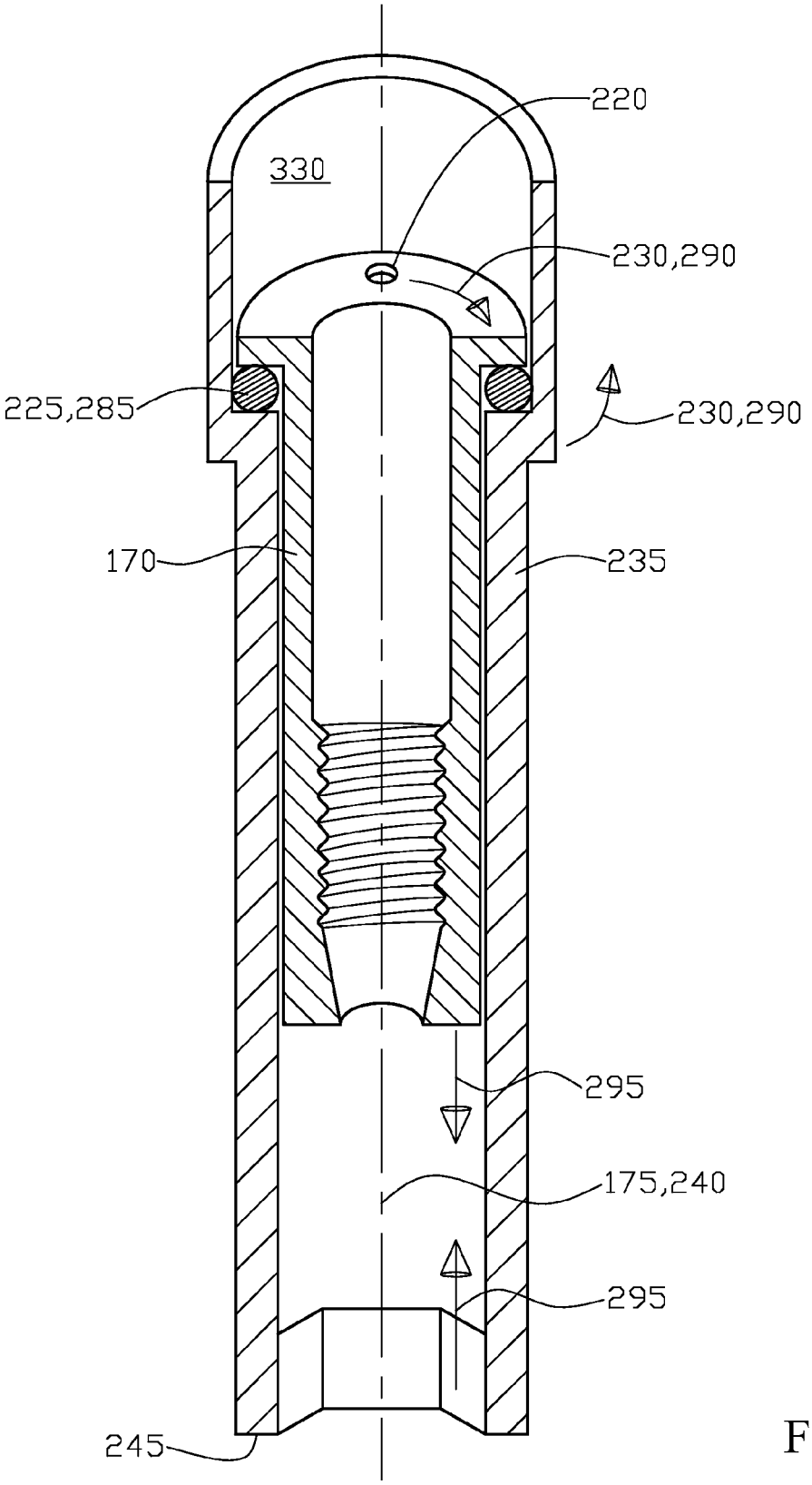
FIG. 8 shows a perspective cross section view of the outer surrounding sidewall and the inner surrounding sidewall assembled with the balls, and the rotational friction reduction or relative rotational movement as between the inner and outer surrounding sidewalls plus the fixed axial position as between the inner and outer surrounding sidewalls as toward the base.

Further, FIG. 8 shows a perspective cross section view of the outer surrounding sidewall 235 and the inner surrounding sidewall 170 assembled with the balls 225, and the rotational friction reduction 230 or relative rotational movement as between the inner 170 and outer 235 surrounding sidewalls plus the fixed axial position 295 as between the inner 170 and outer 235 surrounding sidewalls as toward the base 245. Next, FIG. 9 shows the assembled cross section of FIG. 3 with the addition of the sparkplug 70 shown in position within the tool 50, wherein the fingers 115 are engaged to the terminal electrical interface 95, the hex drive component 85 is received into the inner hex structure 250, with the axial rest point 255, with the co-axial positioning of the longitudinal 110, lengthwise 175, and long 240 axes.

Figure 10:
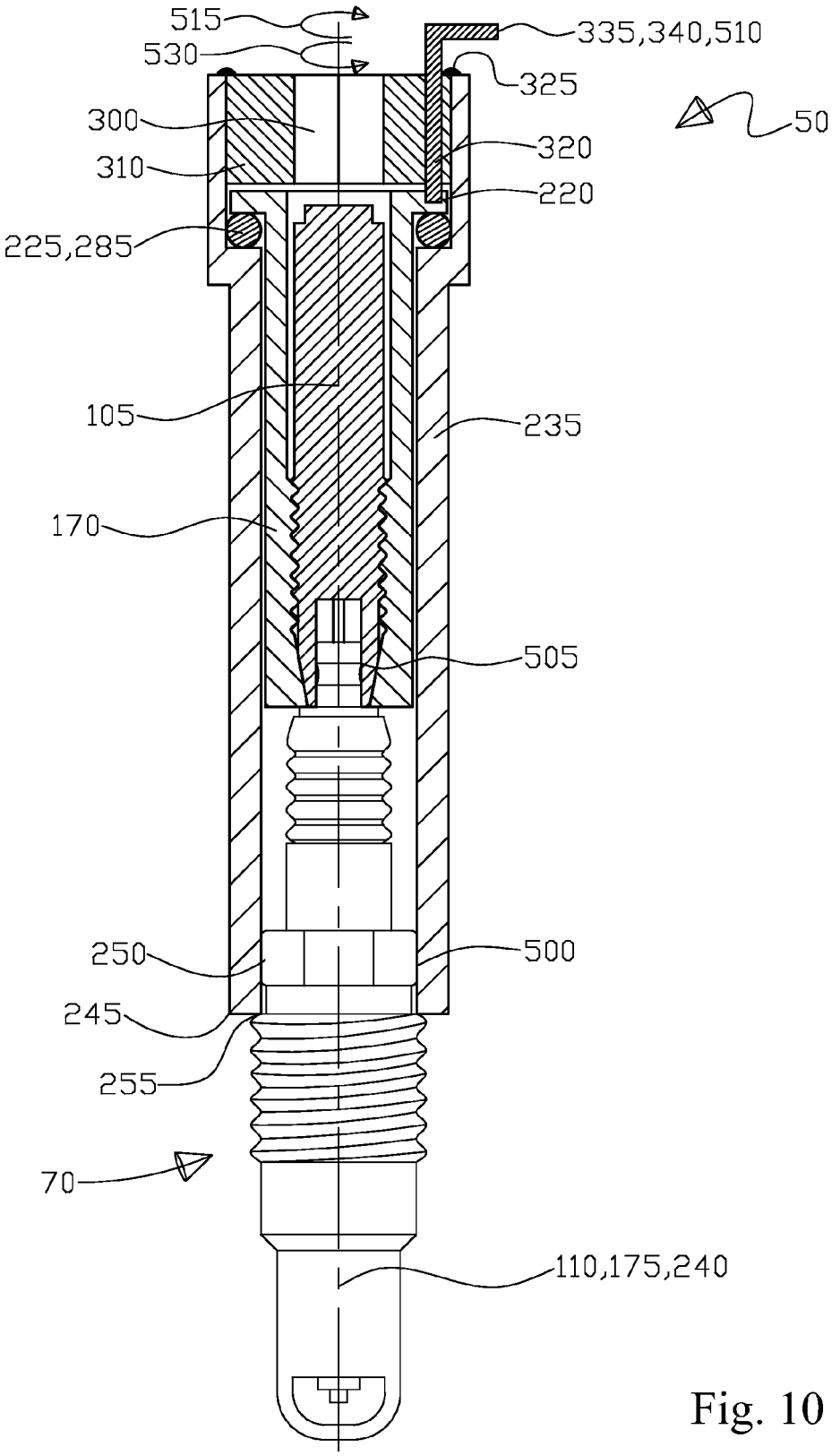
FIG. 10 also shows the assembled cross section of FIG. 3 with the addition of the pin that is inserted into the aperture and onto the receptacle to rotationally lock the outer surrounding sidewall and the inner surrounding sidewall that facilitates imparting the first bidirectional rotation to the collet extension relative to the inner surrounding sidewall such that via the threads accomplishes the purpose of driving the fingers into the inside surface for the fingers to engage the terminal electrical interface extension component of the sparkplug that is shown in position within the tool, wherein the fingers are engaged to the terminal electrical interface, the hex drive component is received into the inner hex structure, with the axial rest point, with the co-axial positioning of the longitudinal, lengthwise, and long axes.

Continuing, FIG. 10 also shows the assembled cross section of FIG. 3 with the addition of the pin 335 that is inserted into the aperture 320 and onto the receptacle 330 to rotationally lock 340 the outer surrounding sidewall 235 and the inner surrounding sidewall 170 that facilitates imparting the first bidirectional rotation 165 to the collet extension 105 relative to the inner surrounding sidewall 170 such that via the threads 145 accomplishes the purpose of driving 130 the fingers 115 into the inside surface 185 for the fingers 115 to engage the terminal electrical interface extension component 95 of the sparkplug 70 that is shown in position within the tool 50, wherein the fingers 115 are engaged to the terminal electrical interface 95, the hex drive component 85 is received into the inner hex structure 250, with the axial rest point 255, with the co-axial positioning of the longitudinal 110, lengthwise 175, and long 240 axes.

Figure 11:
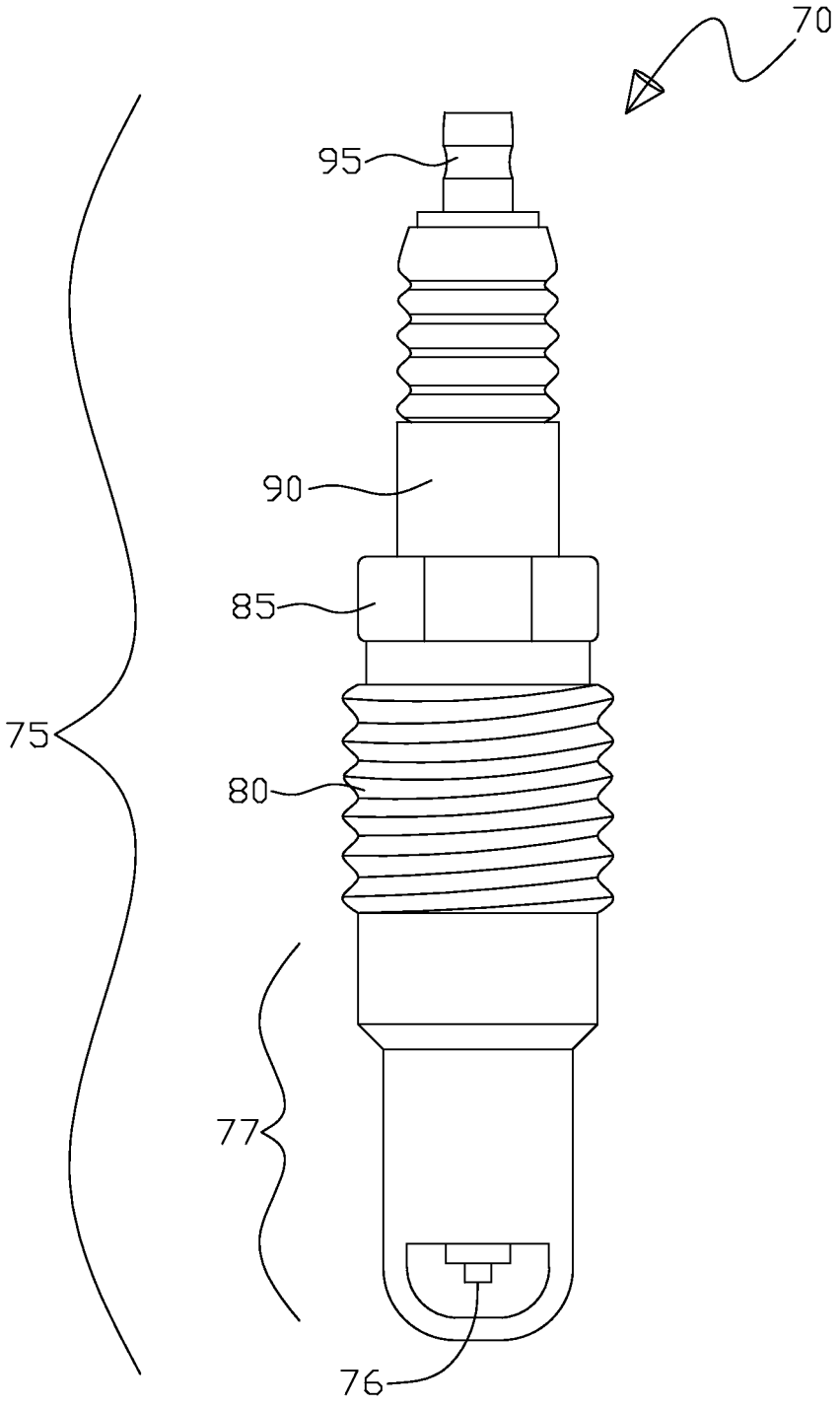
FIG. 11 shows an assembled spark plug having the extended smooth spark arc producing terminal portion, the adjacent helical threaded portion, the adjacent hex drive, the adjacent insulator portion, and the terminal electrical interface extension.
Figure 12:
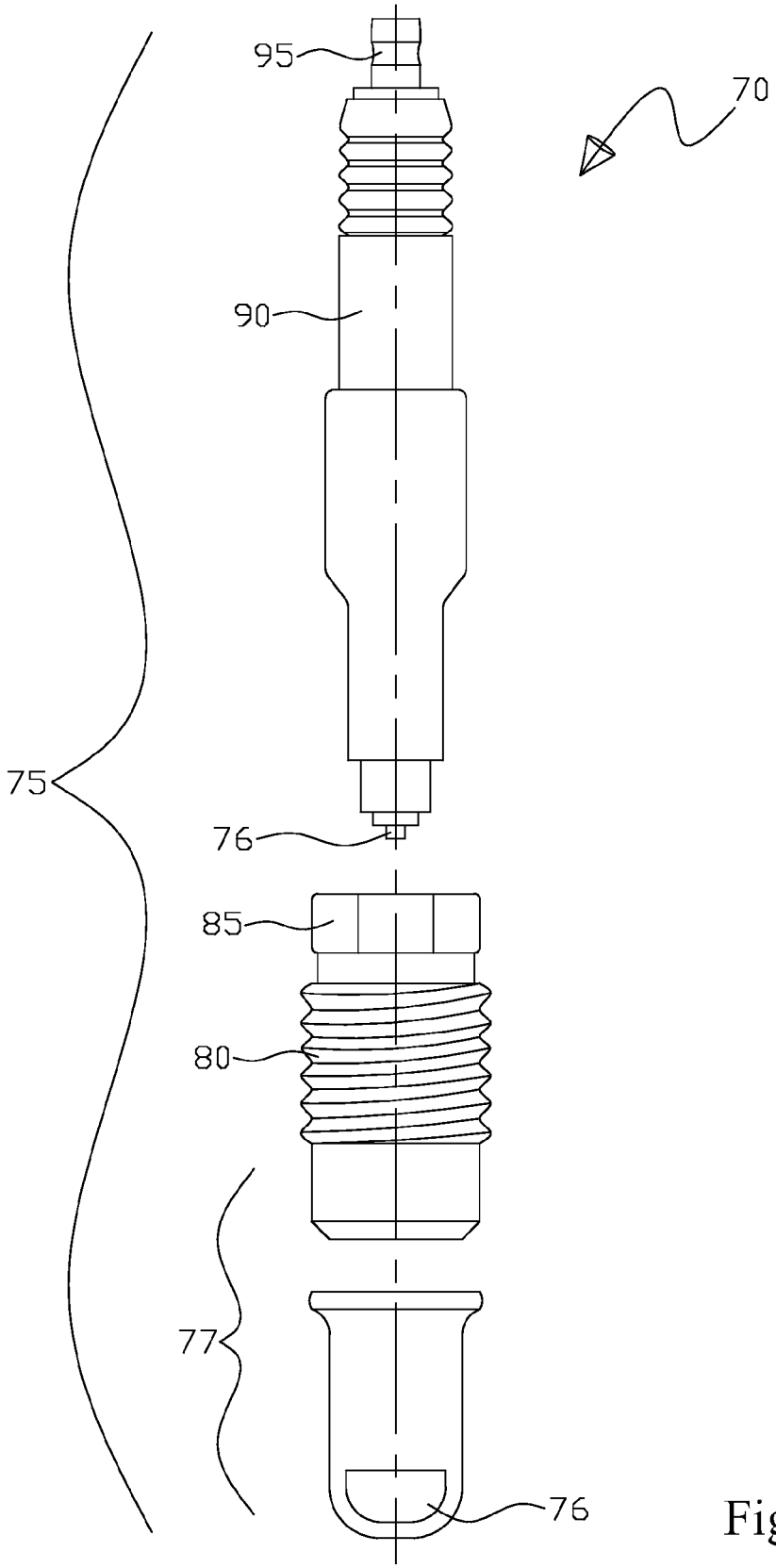
FIG. 12 shows an exploded view of the spark plug having the extended smooth spark arc producing terminal portion, the adjacent helical threaded portion, the adjacent hex drive, the adjacent insulator portion, and the terminal electrical interface extension, wherein the typical separating damage in-between the extended smooth spark arc producing terminal portion and the adjacent helical threaded portion causes the adjacent insulator portion and the terminal electrical interface extension to separate from the extended smooth spark arc producing terminal portion and the adjacent helical threaded portion.

Next, FIG. 11 shows an assembled spark plug 70 having the extended smooth spark arc 76 producing terminal portion 77, the adjacent helical threaded portion 80, the adjacent hex drive 85, the adjacent insulator portion 90, and the terminal electrical interface extension 95. Continuing, FIG. 12 shows an exploded view of the spark plug 70 having the extended smooth spark arc 76 producing terminal portion 77, the adjacent helical threaded portion 80, the adjacent hex drive 85, the adjacent insulator portion 90, and the terminal electrical interface extension 95, wherein the typical separating damage 100 in-between the extended smooth spark arc producing terminal portion 77 and the adjacent helical threaded portion 80 causes the adjacent insulator portion 90 and the terminal electrical interface extension 95 to separate from the extended smooth spark arc 76 producing terminal portion 77 and the adjacent helical threaded portion 80.

Figure 9:
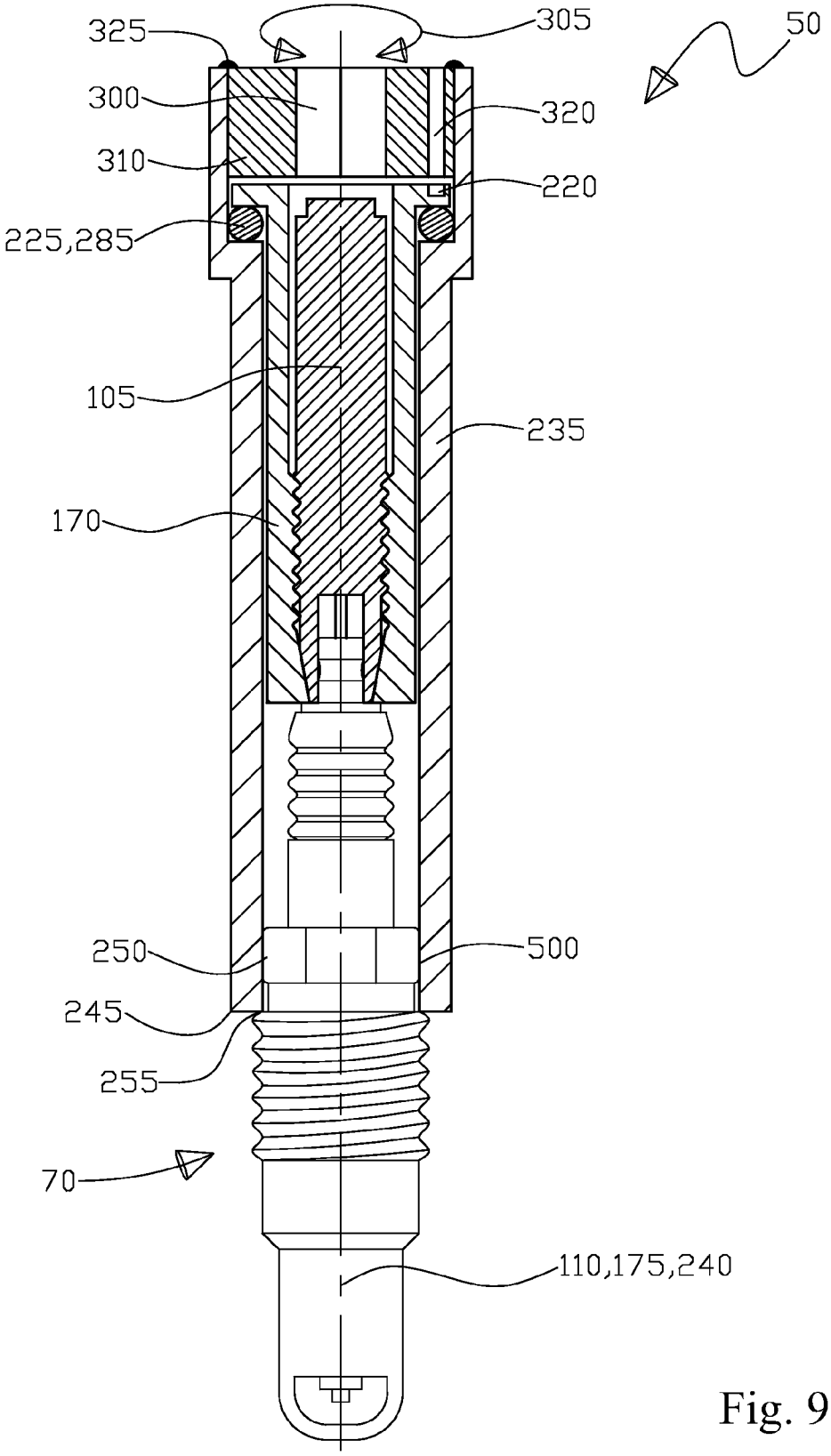
FIG. 9 shows the assembled cross section of FIG. 3 with the addition of the sparkplug shown in position within the tool, wherein the fingers are engaged to the terminal electrical interface, the hex drive component is received into the inner hex structure, with the axial rest point, with the co-axial positioning of the longitudinal, lengthwise, and long axes.
Figure 13:
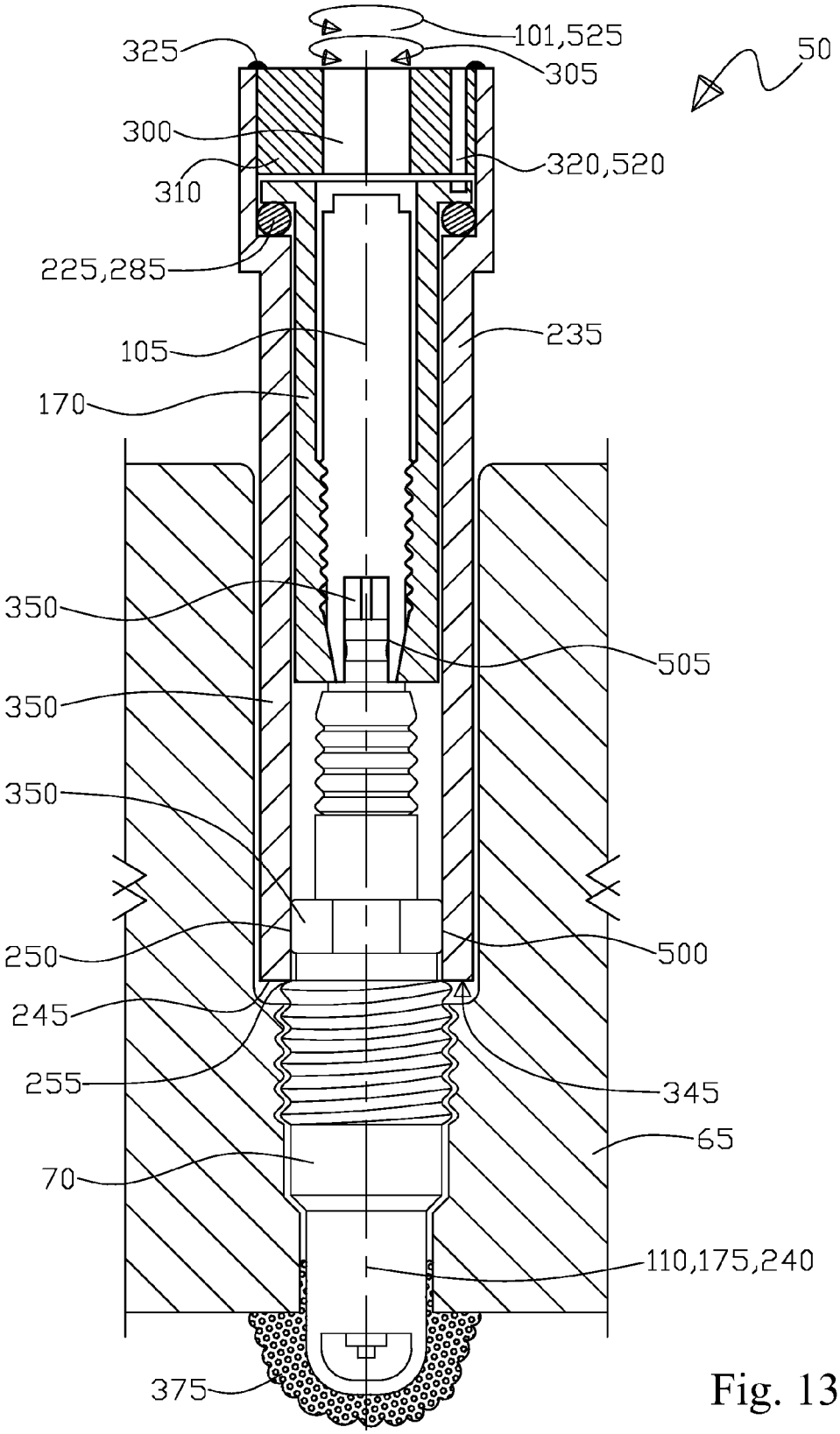
FIG. 13 shows the assembled cross section of FIG. 9 with the sparkplug shown in position within the tool, wherein the fingers are engaged to the terminal electrical interface, the hex drive component is received into the inner hex structure, with the axial rest point, with the co-axial positioning of the longitudinal, lengthwise, and long axes, further showing the spark plug as installed in the engine head with the carbon buildup from engine use over time as between the engine head and the extended smooth spark arc producing terminal portion that tends to "weld" the engine head to the extended smooth spark arc producing terminal portion making attempted removal of the spark plug from the engine head difficult resulting in the typical separating damage in-between the extended smooth spark arc producing terminal portion and the adjacent helical threaded portion as shown in FIG. 12.

Further, FIG. 13 shows the assembled cross section of FIG. 9 with the sparkplug 70 shown in position within the tool 50, wherein the fingers 115 are engaged 120 to the terminal electrical interface 95, the hex drive component 85 is received into the inner hex structure 250, with the axial rest point 255, with the co-axial positioning of the longitudinal 110, lengthwise 175, and long 240 axes. Also, FIG. 13 further shows the spark plug 70 as installed in the engine head 65 with the carbon buildup 375 from engine use over time as between the engine head 65 and the extended smooth spark arc 76 producing terminal portion 77 that tends to "weld" the engine head 65 to the extended smooth spark arc 76 producing terminal portion 77 making attempted removal of the spark plug 70 from the engine head 65 difficult resulting in the typical separating damage 100 in-between the extended smooth spark arc 76 producing terminal portion 77 and the adjacent helical threaded portion 80 as shown in FIG. 12.

Figure 14:
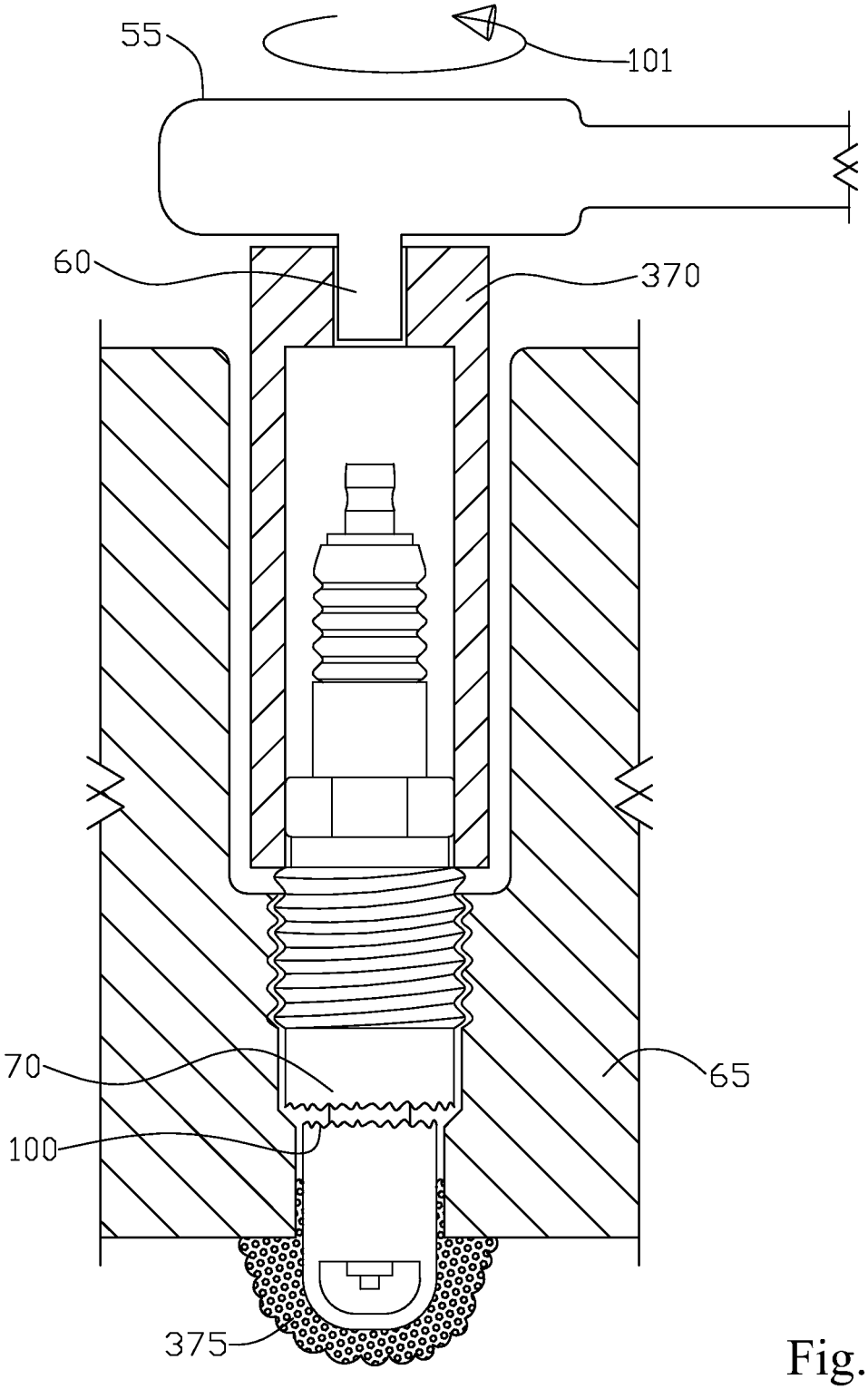
Fig. 14 (Prior Art)
FIG. 14 shows the prior art assembled cross section of a conventional ratchet driver and prior art spark plug removal tool with the sparkplug shown in position within the prior art spark plug removal tool and the spark plug threaded into the engine head with the carbon buildup as in FIG. 13, that tends to "weld" the engine head to the extended smooth spark arc producing terminal portion making attempted removal of the spark plug from the engine head difficult resulting in the typical separating damage in-between the extended smooth spark arc producing terminal portion and the adjacent helical threaded portion, as the extended smooth spark arc producing terminal portion remains "welded" to the engine head wherein the adjacent helical threaded portion component and the adjacent hex drive component have broken away causing separating damage from the extended smooth spark arc producing terminal portion due to unscrewing the spark plug by the prior art ratchet and tool requiring expensive and time consuming extended smooth spark arc producing terminal portion removal from the engine head.

Next, FIG. 14 shows the prior art assembled cross section of a conventional ratchet driver 55 and prior art spark plug removal tool 370 with the sparkplug 70 shown in position within the prior art spark plug removal tool 370 and the spark plug 70 threaded 80 into the engine head 65 with the carbon buildup 375 as in FIG. 13, that tends to "weld" the engine head 65 to the extended smooth spark arc 76 producing terminal portion 77 making attempted removal of the spark plug 70 from the engine head 65 difficult resulting in the typical separating damage 100 in-between the extended smooth spark arc 76 producing terminal portion 77 and the adjacent helical threaded portion 80, as the extended smooth spark arc 76 producing terminal portion 77 remains "welded" to the engine head 65 wherein the adjacent helical threaded portion component 80 and the adjacent hex drive component 85 have broken away 100 causing separating damage 100 from the extended smooth spark arc 76 producing terminal portion 77 due to unscrewing 80 the spark plug 70 by the prior art ratchet 55, extension 60, and tool 370 requiring expensive and time consuming extended smooth spark arc 76 producing terminal portion 77 removal from the engine head 65.

The preferred materials of construction are; for the collet extension 105, the sleeve 310, the inner surrounding sidewall 170, and outer surrounding sidewall 235 are preferably carbon steel, stainless steel, or a suitable equivalent, and for the pin 335 is preferably a typical hardened pin stock, or any other materials that are suitable, the balls 225 are preferably made from hardened steel ball bearing stock, or a suitable equivalent, and for the affixment 325 welding is preferred or a suitable equivalent.

Broadly, in referring to FIGS. 1 through 8, the present invention is for a spark plug removal tool apparatus 50 for a spark plug 70 having an extended smooth spark arc 76 producing terminal portion 77, an adjacent helical threaded portion 80, an adjacent hex drive 85, an adjacent insulator portion 90, and a terminal electrical interface extension 95. The spark plug removal tool apparatus 50 includes a collet extension 105 as best shown in FIG. 4, having a longitudinal axis 110, the collet extension 105 including a removably engaging first end portion 120 having a plurality of cantilevered fingers 115 that flex 125 substantially perpendicular to the longitudinal axis 110, the fingers 115 have an outer portion 135 that is frustroconical, and at an inner portion 140 that is adapted to removably engage the electrical interface extension 95, as shown in FIGS. 9, 10, and 13.

The collet extension 105 also having a threaded 145 mid portion 150 and a second end portion 155 having a first means 160 for imparting a first bidirectional rotational movement 165 about the longitudinal axis 110, see FIG. 4. Further included in the spark plug removal tool apparatus 50 is an inner surrounding sidewall 170, see FIG. 5, having a lengthwise axis 175, the inner surrounding sidewall 170 having a primary end portion 180 with an inside surface 185 that receives the plurality of cantilevered fingers 115 frustroconical outer portion 135, the inner surrounding sidewall 170 also having an intermediate portion 195 with a threaded inner surface 190 that threadably engages the threaded 145 mid portion 150. The inner surrounding sidewall 170 also including an intermediate portion 195 outer surface 200, wherein the longitudinal axis 110 and the lengthwise 175 axis are co-axial, the inner surrounding sidewall 170 also having a secondary end portion 205 with an annular shoulder 210 forming a flange 215 that is positioned about the lengthwise axis 175, also as seen in FIG. 5.

The spark plug removal tool apparatus 50 further includes an outer surrounding sidewall 235, as best shown in FIG. 6, having a long axis 240, the outer surrounding sidewall 235 including a base end portion 245 with an inner hex structure 250 that is adapted to receive the hex drive 85 and axially rest upon the helical threaded portion 80 adjacent to the hex drive 85, as best seen in FIGS. 9, 10, and 13. The outer surrounding sidewall 235 also including a center portion 260 whose inner surface 265 forms a slip fit clearance 270 with an intermediate portion 195 outer surface 200, see FIGS. 2, 3, and 8, the outer surrounding sidewall 235 further including a drive end portion 275 that includes a stepped shoulder 280 that is peripheral about the long axis 240, the stepped shoulder 280 rotationally engages 285 the annular shoulder 210 flange 215 such that the lengthwise axis 175 and long axis 240 are co-axial and the outer surrounding sidewall 235 and the inner surrounding sidewall 170 rotate relative 290 to one another about the lengthwise 175 and long 240 axes, see FIG. 8. Wherein the inner surrounding sidewall 170 is fixed axially 295 in relation to the outer surrounding sidewall 235 for movement toward the base 245, with the movement being parallel to the lengthwise axis 175 and long axes 240, the drive end portion 275 also including a second means 300 for imparting a second rotational movement 305 about the long axis 240, see FIG. 9.

Referring to FIGS. 9 through 14 in particular, operationally for the spark plug removal tool apparatus 50 when the second rotational movement 305 is applied to the second means 300 the second rotational movement 305 is transferred to the adjacent hex drive 85 that starts to unscrew the spark plug 70 from an engine head 65, wherein the helical threaded portion 80 exerts an axial force 345 against the base 245 away from the engine head 65. Wherein the axial force 245 translates to the inner surrounding sidewall 170 via the stepped shoulder 280 and the flange 215 to the collet extension 105 via the threaded inner surface 190 and threaded 145 mid portion 150 to the cantilevered fingers 115 that engage the electrical interface extension 95. This resulting in the axial force 345 acting upon the electrical interface extension 95 in lockstep with the axial force 345 present at the helical threaded portion 80 as against the axial rest point 255, wherein there is no rotational engagement 350 as between the electrical interface extension 95 and the helical threaded portion 80 to help prevent separating damage 100 between all of a portion of the spark plug 70 components of the extended smooth spark arc 76 producing terminal portion 77, the adjacent helical threaded portion 80, the adjacent hex drive 85, the adjacent insulator portion 90, and the terminal electrical interface extension 95, as also shown in FIGS. 12, 13, and 14.

Optionally, on the spark plug removal tool apparatus 50, it can further comprise a plurality of balls 225 disposed between the flange 215 and the stepped shoulder 280, as best shown in FIGS. 2, 3, 8, 9, 10, and 13, wherein operationally the balls 225 reduce rotational friction 230 about the lengthwise 175 and long 240 axes as being between the inner surrounding sidewall 170 and the outer surrounding sidewall 235.

Further, in primarily looking at FIG. 7, for the spark plug removal tool apparatus 50 wherein the second means 300 for imparting a second rotational movement 305 about the long axis 240 is constructed of a sleeve 310 that inserts within a receptacle 330 in the drive end portion 275, wherein the sleeve 310 has an inner surface 315 that is adapted to receive a ratchet driver 55 extension 60 wherein said sleeve is affixed 325 to the drive end portion 275 thus facilitating the second rotational movement 305 to transmit from the sleeve 310 to the outer surrounding sidewall 235 while axially retaining 295 the inner surrounding sidewall 170 within the outer surrounding sidewall 235, as best shown in FIGS. 2, 3, 8, 9, and 10.

Also, again in referring to FIGS. 5 and 7, for the spark plug removal tool apparatus 50 wherein the sleeve 310 has an aperture 320 therethrough positioned parallel to the long axis 240 and the flange 215 has a recess 220 that is in rotational alignment with the aperture 320 wherein a removable pin 335 can be inserted through the aperture 320 and into the recess 220 to rotationally lock 340 the outer surrounding sidewall 235 to the inner surrounding sidewall 170, as best shown in FIG. 10, for the operational purpose of using the first means 160 for imparting the first bidirectional rotational movement 160 about the longitudinal 110 axis to drive 130 the fingers 115 toward one another to engage the electrical interface extension 95.

Method of Use

Looking at FIGS. 9 through 14 in particular for use and FIGS. 1 through 8 for structure, a method is disclosed of removing a spark plug 70 from a head 65, the spark plug 70 having an extended smooth spark arc 76 producing terminal portion 77, an adjacent helical threaded portion 80, an adjacent hex drive 85, an adjacent insulator portion 90, and a terminal electrical interface extension 95, comprising the steps of firstly providing a spark plug removal tool apparatus 50 that includes a collet extension 105 having a longitudinal axis 110. The collet extension 105 including a removably engaging first end portion 120 having a plurality of cantilevered fingers 115 that flex 125 substantially perpendicular to the longitudinal axis 110, the fingers 115 have an outer portion 135 that is frustroconical, and an inner portion 140 that is adapted to removably engage the electrical interface extension 95. The collet extension 105 also having a threaded 145 mid portion 150 and a second end portion 155, wherein first means 160 to impart a first bi-directional rotational movement 165 is preferably constructed of a first hex head 161 for imparting a first bidirectional rotational movement 165 about the longitudinal axis 110, as shown in FIG. 4.

Also included in the spark plug removal tool 50 is an inner surrounding sidewall 170 having a lengthwise axis 175, the inner surrounding sidewall 170 having a primary end portion 180 with an inside surface 185 that receives the plurality of cantilevered fingers 115 frustroconical outer portion 135, the inner surrounding sidewall 170 also having an intermediate portion 195 with a threaded inner surface 190 that threadably engages the threaded 145 mid portion 150 and an intermediate portion outer surface 200, wherein the longitudinal axis 110 and said lengthwise axis 175 are co-axial. The inner surrounding sidewall 170 also having a secondary end portion 205 with an annular shoulder 210 forming a flange 215 that is positioned about the lengthwise axis 175.

Also included in said spark plug removal tool 50 is an outer surrounding sidewall 235 having a long axis 240, the outer surrounding sidewall 235 including a base end portion 245 with an inner hex structure 250 that is adapted to receive the hex drive 85 and axially rest upon 255 the helical threaded portion 80 adjacent to the hex drive 85. The outer surrounding sidewall 235 also including a center portion 260 whose inner surface 265 forms a slip fit clearance 270 with the intermediate portion outer surface 200. The outer surrounding sidewall 235 further including a drive end portion 275 that includes a stepped shoulder 280 that is peripheral about the long axis 240, the stepped shoulder 280 rotationally engages 285 the annular shoulder flange 215 such that the lengthwise axis 175 and long axis 240 are co-axial and the outer surrounding sidewall 235 and the inner surrounding sidewall 170 rotate relative 290 to one another about the lengthwise 175 and long 240 axes.

Wherein the inner surrounding sidewall 170 is fixed axially 295 in relation to the outer surrounding sidewall 235 for movement toward the base 245, with the movement being parallel to the lengthwise axis 175 and long 240 axes, the drive end portion 275 also including a sleeve 310 that inserts within a receptacle 330 in the drive end portion 275. The sleeve 310 has an inner surface 315 that is adapted to receive a ratchet driver 55 extension 60 wherein the sleeve 310 is affixed 325 to the drive end portion 275 thus facilitating a second rotational movement 305 about the long axis 240 to transmit the second rotational movement 305 from the sleeve 310 to the outer surrounding sidewall 235 while axially retaining 295 the inner surrounding sidewall 170 within the outer surrounding sidewall 235. The sleeve 310 has an aperture 320 therethrough positioned parallel to the long axis 240 and the flange 215 has a recess 220 that is in rotational alignment with the aperture 320 wherein a removable pin 335 can be inserted through the aperture 320 and into the recess 220 to rotationally lock 340 the outer surrounding sidewall 235 to the inner surrounding sidewall 170 for the operational purpose of using the first means 160 for imparting a first bidirectional rotational movement 165 about the longitudinal axis 110 to drive 130 the fingers 115 toward one another to engage the electrical interface extension 95.

Wherein operationally, see FIG. 13 in particular, when the second rotational movement 305 is applied to the sleeve 310, the second rotational movement 305 is transferred to the adjacent hex drive 85 that starts to unscrew the spark plug 70 from an engine head 65 wherein the helical threaded portion 80 exerts an axial force 345 against the base 245 away from the engine head 65, wherein the axial force 345 translates to the inner surrounding sidewall 170 via the stepped shoulder 280 and the flange 215 to the collet extension 105 via the threaded inner surface 190 and threaded 145 mid portion 150 to the cantilevered fingers 115 that engage the electrical interface extension 95. This results in the axial force 345 acting upon the electrical interface extension 95 in lockstep with the axial force present 345 at the helical threaded portion 80, wherein there is no rotational engagement 350 as between the electrical interface extension 95 and the helical threaded portion 80 to help prevent separating damage 100 between all of a portion of the spark plug 70 components of the extended smooth spark arc 76 producing terminal portion 77, the adjacent helical threaded portion 80, the adjacent hex drive 85, the adjacent insulator portion 90, and the terminal electrical interface extension 95.

The next step is in placing 500 base end portion 245 and the inner hex structure 250 upon the spark plug hex drive 85 while the base end portion 245 axially rests 255 upon the spark plug helical threaded portion 80 while simultaneously inserting 505 the terminal electrical interface extension 95 into the collet extension 105 fingers 115 inner portion 140, see FIGS. 9, 10, and 13. Continuing, a step of placing 510 the pin 335 through the aperture 320 and into the recess 220 to rotationally lock 340 the outer surrounding sidewall 235 to the inner surrounding sidewall 170 see FIG. 10. A further step is in, rotating 515 the first hex head 161 to drive 130 the fingers 115 into the primary end portion 180 inside surface 185 for the fingers 115 to engage the terminal electrical interface extension 95, see FIGS. 9, 10, and 13. A next step 520 is in removing the pin 335 from the recess 220 and the aperture 320. A further step is in rotating 525 the sleeve 310 to unscrew 101 the spark plug 70 from the head 65, see FIG. 13.

An added step of inserting the pin 335 through the aperture 320 and into the recess 220 to rotationally lock 340 the outer surrounding sidewall 235 to the inner surrounding sidewall 170 and rotating 530 the first hex head 161 to retract 131 the fingers 115 from the primary end portion 180 inside surface 185 for the fingers 115 to disengage 132 the terminal electrical interface extension 95 to allow spark plug 70 removal from the spark plug removal tool apparatus 50.

CONCLUSION

Accordingly, the present invention of a spark plug removal tool apparatus 50 has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. A spark plug removal tool apparatus for a spark plug having an extended smooth spark producing terminal portion, an adjacent helical threaded portion, an adjacent hex drive, an adjacent insulator portion, and a terminal electrical interface extension, said spark plug removal tool apparatus comprising:

(a) a collet extension having a longitudinal axis, said collet extension including a removably engaging first end portion having a plurality of cantilevered fingers that flex substantially perpendicular to said longitudinal axis, said fingers have an outer portion that is frustroconical, and at an inner portion that is adapted to removably engage the electrical interface extension, said collet extension also having a threaded mid portion and a second end portion having a first means for imparting a first bidirectional rotational movement about said longitudinal axis;

(b) an inner surrounding sidewall having a lengthwise axis, said the inner surrounding sidewall having a primary end portion with an inside surface that receives said plurality of cantilevered fingers frustroconical outer portion, said inner surrounding sidewall also having an intermediate portion with a threaded inner surface that threadably engages said threaded mid portion, said inner surrounding sidewall also including an intermediate portion outer surface, wherein said longitudinal axis and said lengthwise axis are co-axial, said inner surrounding sidewall also having a secondary end portion with an annular shoulder forming a flange that is positioned about said lengthwise axis; and (c) an outer surrounding sidewall having a long axis, said outer surrounding sidewall including a base end portion with an inner hex structure that is adapted to receive the hex drive and axially rest upon the helical threaded portion adjacent to the hex drive, said outer surrounding sidewall also including a center portion whose inner surface forms a slip fit clearance with said an intermediate portion outer surface, said outer surrounding sidewall further including a drive end portion that includes a stepped shoulder that is peripheral about said long axis, said stepped shoulder rotationally engages said annular shoulder flange such that said lengthwise axis and long axis are co-axial and said outer surrounding sidewall and said inner surrounding sidewall rotate relative to one another about said lengthwise and long axes, wherein said inner surrounding sidewall is fixed axially in relation to said outer surrounding sidewall for movement toward said base, with said movement being parallel to said lengthwise axis and long axes, said drive end portion also including a second means for imparting a second rotational movement about said long axis, wherein operationally when said second rotational movement is applied to said second means said second rotational movement is transferred to the adjacent hex drive that starts to unscrew the spark plug from an engine head wherein the helical threaded portion exerts an axial force against said base away from the engine head, wherein said axial force translates to said inner surrounding sidewall via said stepped shoulder and said flange to said collet extension via said threaded inner surface and threaded mid portion to said cantilevered fingers that engage the electrical interface extension, resulting in said axial force acting upon the electrical interface extension in lockstep with said axial force present at the helical threaded portion, wherein there is no rotational engagement as between the electrical interface extension and the helical threaded portion to help prevent separating damage between all of a portion of the spark plug components of the extended smooth spark producing terminal portion, the adjacent helical threaded portion, the adjacent hex drive, the adjacent insulator portion, and the terminal electrical interface extension.

2. A spark plug removal tool apparatus according to claim 1 further comprising a plurality of balls disposed between said flange and said stepped shoulder, wherein operationally said balls reduce rotational friction about said lengthwise and long axes as being between said inner surrounding sidewall and said outer surrounding sidewall.

3. A spark plug removal tool apparatus according to claim 1 wherein said second means for imparting a second rotational movement about said long axis is constructed of a sleeve that inserts within a receptacle in said drive end portion, said sleeve has an inner surface that is adapted to receive a ratchet driver extension wherein said sleeve is affixed to said drive end portion thus facilitating said second rotational movement to transmit from said sleeve to said outer surrounding sidewall while axially retaining said inner surrounding sidewall within said outer surrounding sidewall.

4. A spark plug removal tool apparatus according to claim 3 wherein said sleeve has an aperture therethrough positioned parallel to said long axis and said flange has a recess that is in rotational alignment with said aperture wherein a removable pin can be inserted through said aperture and into said recess to rotationally lock said outer surrounding sidewall to said inner surrounding sidewall for the operational purpose of using said first means for imparting said first bidirectional rotational movement about said longitudinal axis to drive said fingers toward one another to engage the electrical interface extension.

5. A method of removing a spark plug from a head, the spark plug having an extended smooth spark producing terminal portion, an adjacent helical threaded portion, an adjacent hex drive, an adjacent insulator portion, and a terminal electrical interface extension, comprising the steps of:

(a) providing a spark plug removal tool apparatus that includes a collet extension having a longitudinal axis, said collet extension including a removably engaging first end portion having a plurality of cantilevered fingers that flex substantially perpendicular to said longitudinal axis, said fingers have an outer portion that is frustroconical, and an inner portion that is adapted to removably engage the electrical interface extension, said collet extension also having a threaded mid portion and a second end portion having a first hex head for imparting a first bidirectional rotational movement about said longitudinal axis, also included in said spark plug removal tool is an inner surrounding sidewall having a lengthwise axis, said inner surrounding sidewall having a primary end portion with an inside surface that receives said plurality of cantilevered fingers frustroconical outer portion, said inner surrounding sidewall also having an intermediate portion with a threaded inner surface that threadably engages said threaded mid portion and an intermediate portion outer surface, wherein said longitudinal axis and said lengthwise axis are co-axial, said inner surrounding sidewall also having a secondary end portion with an annular shoulder forming a flange that is positioned about said lengthwise axis, also included in said spark plug removal tool is an outer surrounding sidewall having a long axis, said outer surrounding sidewall including a base end portion with an inner hex structure that is adapted to receive the hex drive and axially rest upon the helical threaded portion adjacent to the hex drive, said outer surrounding sidewall also including a center portion whose inner surface forms a slip fit clearance with said intermediate portion outer surface, said outer surrounding sidewall further including a drive end portion that includes a stepped shoulder that is peripheral about said long axis, said stepped shoulder rotationally engages said annular shoulder flange such that said lengthwise axis and long axis are co-axial and said outer surrounding sidewall and said inner surrounding sidewall rotate relative to one another about said lengthwise and long axes, wherein said inner surrounding sidewall is fixed axially in relation to said outer surrounding sidewall for movement toward said base, with said movement being parallel to said lengthwise axis and long axes, said drive end portion also including a sleeve that inserts within a receptacle in said drive end portion, said sleeve has an inner surface that is adapted to receive a ratchet driver extension wherein said sleeve is affixed to said drive end portion thus facilitating a second rotational movement about said long axis to transmit said second rotational movement from said sleeve to said outer surrounding sidewall while axially retaining said inner surrounding sidewall within said outer surrounding sidewall, said sleeve has an aperture therethrough positioned parallel to said long axis and said flange has a recess that is in rotational alignment with said aperture wherein a removable pin can be inserted through said aperture and into said recess to rotationally lock said outer surrounding sidewall to said inner surrounding sidewall for the operational purpose of using said first means for imparting a first bidirectional rotational movement about said longitudinal axis to drive said fingers toward one another to engage the electrical interface extension, wherein operationally when said second rotational movement is applied to said sleeve, said second rotational movement is transferred to the adjacent hex drive that starts to unscrew the spark plug from an engine head wherein the helical threaded portion exerts an axial force against said base away from the engine head, wherein said axial force translates to said inner surrounding sidewall via said stepped shoulder and said flange to said collet extension via said threaded inner surface and threaded mid portion to said cantilevered fingers that engage the electrical interface extension, resulting in said axial force acting upon the electrical interface extension in lockstep with said axial force present at the helical threaded portion, wherein there is no rotational engagement as between the electrical interface extension and the helical threaded portion to help prevent separating damage between all of a portion of the spark plug components of the extended smooth spark producing terminal portion, the adjacent helical threaded portion, the adjacent hex drive, the adjacent insulator portion, and the terminal electrical interface extension;

(b) placing said base end portion and said inner hex structure upon the spark plug hex drive while said base end portion axially rests upon the spark plug helical threaded portion while simultaneously inserting the terminal electrical interface extension into said collet extension fingers inner portion;

(c) placing said pin through said aperture and into said recess to rotationally lock said outer surrounding sidewall to said inner surrounding sidewall;

(d) rotating said first hex head to drive said fingers into said primary end portion inside surface for said fingers to engage the terminal electrical interface extension;

(e) removing said pin from said recess and said aperture; and (f) rotating said sleeve to unscrew the spark plug from the head.

6. A method of removing a spark plug from a head according to claim 5, further comprising a step after step (f) of inserting said pin through said aperture and into said recess to rotationally lock said outer surrounding sidewall to said inner surrounding sidewall and rotating said first hex head to retract said fingers from said primary end portion inside surface for said fingers to disengage the terminal electrical interface extension to allow spark plug removal from said spark plug removal tool apparatus.

* * * * *